US012029935B2

(12) United States Patent
Smith

(10) Patent No.: US 12,029,935 B2
(45) Date of Patent: Jul. 9, 2024

(54) ADJUSTMENT MECHANISM FOR AN ADJUSTABLE KETTLEBELL

(71) Applicant: iFIT Inc., Logan, UT (US)

(72) Inventor: Kent M. Smith, Nibley, UT (US)

(73) Assignee: iFIT Inc., Logan, UT (US)

( * ) Notice: Subject to any disclaimer, the term of this patent is extended or adjusted under 35 U.S.C. 154(b) by 224 days.

(21) Appl. No.: 17/891,831

(22) Filed: Aug. 19, 2022

(65) Prior Publication Data

US 2023/0054845 A1 Feb. 23, 2023

Related U.S. Application Data

(60) Provisional application No. 63/235,002, filed on Aug. 19, 2021.

(51) Int. Cl.
*A63B 21/075* (2006.01)

(52) U.S. Cl.
CPC ..... *A63B 21/075* (2013.01)

(58) Field of Classification Search
CPC ..... A63B 21/072; A63B 21/075
See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang et al. |
| 4,023,795 | A | 5/1977 | Pauls |
| 4,300,760 | A | 11/1981 | Bobroff |
| D286,311 | S | 10/1986 | Martinell et al. |
| 4,681,318 | A | 7/1987 | Lay |
| 4,684,126 | A | 8/1987 | Dalebout et al. |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,830,371 | A | 5/1989 | Lay |
| 4,844,451 | A | 7/1989 | Bersonnet et al. |
| 4,850,585 | A | 7/1989 | Dalebout et al. |
| D304,849 | S | 11/1989 | Watterson |
| 4,880,225 | A | 11/1989 | Lucas et al. |
| 4,883,272 | A | 11/1989 | Lay |
| D306,468 | S | 3/1990 | Watterson |
| D306,891 | S | 3/1990 | Watterson |
| 4,913,396 | A | 4/1990 | Dalebout et al. |
| D307,614 | S | 5/1990 | Bingham et al. |
| D307,615 | S | 5/1990 | Bingham et al. |

(Continued)

OTHER PUBLICATIONS

U.S. Appl. No. 17/066,485, filed Oct. 9, 2020, Weston et al.

(Continued)

*Primary Examiner* — Zachary T Moore
(74) *Attorney, Agent, or Firm* — Ray Quinney & Nebeker P.C.; Paul N. Taylor

(57) ABSTRACT

An adjustable kettlebell system includes a base having a rod extending from the base. A selector is threaded onto the rod. The rod and selector extend through a plurality of weight supports. Each weight support is connected to an underlying weight support with a connector. As the selector is moved along the length of the rod by rotating the rod, the selector causes the connector to disengage with the underlying weight support. The adjustable kettlebell is then removed without the underlying weight support connected to the handle.

20 Claims, 12 Drawing Sheets

(56) References Cited

U.S. PATENT DOCUMENTS 4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.

(56) References Cited

U.S. PATENT DOCUMENTS 5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,377,885 B2 * 5/2008 Doudiet ..... A63B 21/0728 482/107
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,578,772 B2 * 8/2009 Lippitt ..... A63B 21/075 482/106
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,762,933 B1 * 7/2010 Yu ..... A63B 21/075 482/109
7,766,797 B2 8/2010 Dalebout et al.
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,981,012 B1 * 7/2011 Krull ..... A63B 21/0728 482/107
7,985,164 B2 7/2011 Ashby
8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.
D659,777 S 5/2012 Watterson et al.
D660,383 S 5/2012 Watterson et al.
D664,613 S 7/2012 Dalebout et al.

(56) References Cited

U.S. PATENT DOCUMENTS 8,251,874 B2 8/2012 Ashby et al.
8,298,123 B2 10/2012 Hickman
8,298,125 B2 10/2012 Colledge et al.
D671,177 S 11/2012 Sip
D671,178 S 11/2012 Sip
D673,626 S 1/2013 Olson et al.
8,690,735 B2 4/2014 Watterson et al.
D707,763 S 6/2014 Cutler
8,740,753 B2 6/2014 Olson et al.
8,758,201 B2 6/2014 Ashby et al.
8,771,153 B2 7/2014 Dalebout et al.
8,784,270 B2 7/2014 Ashby et al.
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,911,330 B2 12/2014 Watterson et al.
8,920,288 B2 12/2014 Dalebout et al.
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,072,930 B2 7/2015 Ashby et al.
9,119,983 B2 9/2015 Rhea
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 10/2015 Watterson et al.
9,186,535 B2 11/2015 Ercanbrack
9,186,549 B2 11/2015 Watterson et al.
9,254,409 B2 2/2016 Dalebout et al.
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
9,327,159 B1 * 5/2016 Medina ..... A63B 21/0726
9,339,691 B2 5/2016 Brammer
9,352,185 B2 5/2016 Hendrickson et al.
9,352,186 B2 5/2016 Watterson
9,375,605 B2 6/2016 Tyger et al.
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson et al.
9,636,567 B2 5/2017 Brammer et al.
9,675,839 B2 6/2017 Dalebout et al.
9,682,307 B2 6/2017 Dalebout
9,694,234 B2 7/2017 Dalebout et al.
9,694,242 B2 7/2017 Ashby et al.
9,737,755 B2 8/2017 Dalebout
9,757,605 B2 9/2017 Olson et al.
9,764,186 B2 9/2017 Dalebout et al.
9,767,785 B2 9/2017 Ashby et al.
9,795,822 B2 * 10/2017 Smith ..... A63B 24/0087
9,808,672 B2 11/2017 Dalebout
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen et al.
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack et al.
D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson et al.
10,207,143 B2 2/2019 Dalebout et al.
10,207,145 B2 2/2019 Tyger et al.
10,207,147 B2 2/2019 Ercanbrack et al.
10,207,148 B2 2/2019 Powell et al.
10,212,994 B2 2/2019 Watterson et al.
10,220,259 B2 3/2019 Brammer
10,226,396 B2 3/2019 Ashby
10,226,664 B2 3/2019 Dalebout et al.
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell
10,449,416 B2 10/2019 Dalebout et al.
10,471,299 B2 11/2019 Powell
D868,909 S 12/2019 Cutler et al.
10,492,519 B2 12/2019 Capell et al.
10,493,349 B2 12/2019 Watterson
10,500,473 B2 12/2019 Watterson
10,537,764 B2 1/2020 Smith et al.
10,543,395 B2 1/2020 Powell et al.
10,561,877 B2 2/2020 Workman
10,561,893 B2 2/2020 Chatterton et al.
10,561,894 B2 2/2020 Dalebout et al.
10,569,121 B2 2/2020 Watterson

(56) References Cited

U.S. PATENT DOCUMENTS 10,569,123 B2 2/2020 Hochstrasser et al.
10,625,114 B2 4/2020 Ercanbrack
10,625,137 B2 4/2020 Dalebout et al.
10,661,114 B2 5/2020 Watterson et al.
10,668,320 B2 6/2020 Watterson
10,671,705 B2 6/2020 Capell et al.
10,688,346 B2 6/2020 Brammer
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson et al.
10,786,706 B2 9/2020 Smith
10,864,407 B2 12/2020 Watterson et al.
10,918,905 B2 2/2021 Powell et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,967,214 B1 4/2021 Olson et al.
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,187,285 B2 11/2021 Wrobel
11,278,760 B1 * 3/2022 Hutchinson ..... A63B 21/4035
11,298,577 B2 4/2022 Watterson
11,326,673 B2 5/2022 Buchanan
11,338,169 B2 5/2022 Dalebout et al.
11,338,175 B2 5/2022 Watterson et al.
11,426,633 B2 8/2022 Watterson et al.
11,451,108 B2 9/2022 Tinney
11,452,903 B2 9/2022 Watterson
11,511,152 B2 11/2022 Powell et al.
11,534,651 B2 12/2022 Ercanbrack et al.
11,534,654 B2 12/2022 Silcock et al.
11,534,655 B2 12/2022 Dalebout et al.
11,565,148 B2 1/2023 Dalebout et al.
11,596,830 B2 3/2023 Dalebout et al.
11,642,564 B2 5/2023 Watterson
11,673,036 B2 6/2023 Dalebout et al.
11,680,611 B2 6/2023 Wrobel
11,700,905 B2 7/2023 Ashby et al.
11,708,874 B2 7/2023 Wrobel
2007/0184945 A1 * 8/2007 Lin ..... A63B 21/075
482/107
2008/0051256 A1 2/2008 Ashby et al.
2011/0263393 A1 * 10/2011 Ross ..... A63B 21/072
482/93
2012/0053024 A1 * 3/2012 Mendoza ..... A63B 21/0722
482/106
2015/0251055 A1 9/2015 Ashby
2016/0089560 A1 * 3/2016 Smith ..... A63B 24/0087
482/108
2017/0124912 A1 5/2017 Ashby et al.
2017/0193578 A1 7/2017 Watterson
2017/0266489 A1 9/2017 Douglass et al.
2017/0270820 A1 9/2017 Ashby et al.
2018/0085630 A1 3/2018 Capell et al.
2018/0099116 A1 4/2018 Ashby
2018/0099180 A1 4/2018 Wilkinson
2018/0111034 A1 4/2018 Watterson
2018/0117387 A1 * 5/2018 Wang ..... A63B 21/072
2019/0223612 A1 7/2019 Watterson et al.
2019/0269971 A1 9/2019 Capell et al.
2019/0299047 A1 * 10/2019 Nalley ..... A63B 21/0726
2020/0009417 A1 1/2020 Dalebout
2020/0391069 A1 8/2020 Olson et al.
2020/0360757 A1 * 11/2020 Flick ..... A63B 71/0054
2020/0368575 A1 11/2020 Hays et al.
2021/0001177 A1 1/2021 Smith
2021/0023411 A1 * 1/2021 Wang ..... A63B 21/075
2021/0046353 A1 2/2021 Dalebout et al.
2021/0106899 A1 4/2021 Willardson et al.
2021/0110910 A1 4/2021 Ostler et al.
2021/0146221 A1 5/2021 Dalebout et al.
2021/0213331 A1 7/2021 Watterson
2021/0268336 A1 9/2021 Watterson et al.
2021/0291013 A1 9/2021 Nascimento
2021/0299518 A1 9/2021 Brammer et al.
2021/0299542 A1 9/2021 Brammer et al.
2021/0322817 A1 * 10/2021 Chen ..... A63B 21/0728
2021/0339079 A1 11/2021 Dalebout et al.
2022/0062685 A1 3/2022 Ashby et al.
2022/0104992 A1 4/2022 Ashby
2022/0212052 A1 * 7/2022 Ercanbrack ..... A63B 21/0726
2022/0241649 A1 8/2022 Ashby
2022/0241665 A1 8/2022 Dalebout et al.
2022/0241668 A1 8/2022 Willardson et al.
2022/0249912 A1 8/2022 Watterson et al.
2022/0257994 A1 8/2022 Smith
2022/0258007 A1 8/2022 Watterson et al.
2022/0258008 A1 8/2022 Watterson et al.
2022/0266085 A1 8/2022 Dalebout et al.
2022/0280857 A1 9/2022 Watterson
2022/0309042 A1 9/2022 Archer
2022/0314078 A1 10/2022 Watterson et al.
2022/0323827 A1 10/2022 Watterson et al.
2022/0339493 A1 10/2022 Larsen
2022/0339520 A1 10/2022 Toth
2022/0342969 A1 10/2022 Watterson et al.
2022/0347516 A1 11/2022 Taylor
2022/0347548 A1 11/2022 Watterson
2022/0355163 A1 * 11/2022 Aly ..... A63B 21/075
2022/0362613 A1 11/2022 Watterson et al.
2022/0362624 A1 11/2022 Dalebout
2022/0395729 A1 12/2022 Toth
2023/0039903 A1 2/2023 Brammer et al.
2023/0054845 A1 * 2/2023 Smith ..... A63B 21/072
2023/0122235 A1 4/2023 Ashby et al.
2023/0128721 A1 4/2023 Plummer
2023/0158358 A1 5/2023 Ercanbrack et al.
2023/0173327 A1 * 6/2023 Wang ..... A63B 21/0724
482/107
2023/0181993 A1 6/2023 Taylor et al.
2023/0191189 A1 6/2023 Taylor et al.
2023/0191197 A1 6/2023 Ashby
2023/0218975 A1 7/2023 Toles et al.
2023/0226401 A1 7/2023 Watterson
2023/0364461 A1 * 11/2023 Sisler ..... A63B 21/0728

OTHER PUBLICATIONS

U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/103,221, filed Jan. 30, 2023, Dalebout et al.
U.S. Appl. No. 18/114,758, filed Feb. 27, 2023, Cutler et al.
U.S. Appl. No. 18/117,263, filed Mar. 3, 2023, Smith et al.
U.S. Appl. No. 18/123,026, filed Mar. 17, 2023, Silcock et al.
U.S. Appl. No. 18/132,277, filed Apr. 7, 2023, Vasquez et al.
U.S. Appl. No. 18/136,535, filed Apr. 19, 2023, Ashby et al.
U.S. Appl. No. 18/141,872, filed May 1, 2023, Ashby et al.
U.S. Appl. No. 18/205,299, filed Jun. 2, 2023, Wrobel.
U.S. Appl. No. 18/207,512, filed Jun. 8, 2023, Chuang.
U.S. Appl. No. 18/210,505, filed Jun. 15, 2023, Nielsen et al.
U.S. Appl. No. 29/702,127, filed Sep. 16, 2019, Cutler et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.

(56) References Cited

OTHER PUBLICATIONS

U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al.
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.

* cited by examiner

ADJUSTMENT MECHANISM FOR AN ADJUSTABLE KETTLEBELL

CROSS-REFERENCE TO RELATED APPLICATIONS

This application claims priority to and the benefit of U.S. Provisional Patent Application No. 63/235,002, filed on Aug. 19, 2021, which is hereby incorporated by reference in its entirety.

BACKGROUND

To improve personal fitness, many people perform exercise activities by moving exercise accessories, such as weights, in a pre-determined path. By varying the weight and/or the motion the user moves the weight through, the user may exercise different muscles. One type of exercise accessory includes a kettlebell, which includes a weight connected to a large handle. The user may grip the kettlebell by the handle and perform movements while holding the kettlebell. To accommodate different exercise activities, a user may desire to perform the exercise activity with multiple different weights of the kettlebell. In some situations, the user may have a stockpile of multiple kettlebells of multiple weights. This kettlebell set may be expensive to acquire and/or take up a large amount of room in a user's home.

BRIEF SUMMARY

In some embodiments, a kettlebell system includes a base, a rod extending up from the base, and a selector that is slidingly attached to the rod. A first weight support rests on the base, and a second weight support is stacked on the first weight support. The rod extends through the first weight support and the second weight support. The second weight support includes a connector. In a connected position, the connector is connected to the first weight support, and in a disconnected position, the connector is not connected to the first weight support.

In some embodiments, a method for adjusting a weight of an adjustable kettlebell includes rotating a rod connected to a base of the adjustable kettlebell. The rod extends through the adjustable kettlebell, which includes a plurality of weight plates. Based on the rotation of the rod, a selector is slid along the length of the rod. When the selector contacts a connector on one of the weight plates, the selector moves the connector from the connected position to the disconnected position, based on its position along the rod.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 1-2 is a cut-away view of the adjustable kettlebell system of FIG. 1-1, according to at least one embodiment of the present disclosure;

FIG. 2-1 through FIG. 2-7 is a schematic diagram of an adjustable kettlebell having different connected weights, according to at least one embodiment of the present disclosure;

FIG. 3 is a representation of an adjustable kettlebell system, according to at least one embodiment of the present disclosure;

FIG. 4 is a schematic representation of an adjustable kettlebell system, according to at least one embodiment of the present disclosure; and FIG. 5 is a flowchart of a method for adjusting a connected weight of an adjustable kettlebell, according to at least one embodiment of the present disclosure.

DETAILED DESCRIPTION

This disclosure generally relates to devices, systems, and methods for adjustable kettlebell systems. An adjustable kettlebell system includes a motor in a base of the cradle. The motor may spin a threaded rod that is connected to the base. A selector may be threaded onto the rod. As the motor spins the rod, the selector may travel along the length of the rod. Several weight supports are stacked on the base so that the rod extends through the weight supports. A connector located in the weight supports connects each weight support to the underlying weight support. The selector may contact or engage the connector, thereby disconnecting the weight support from the underlying weight support. By selectively disconnecting weight supports, the weight of the kettlebell may be adjusted.

The selection mechanism of the present disclosure may be included primarily in the cradle of the adjustable kettlebell. This may simplify the construction of the handle and/or the weight plates. In accordance with embodiments of the present disclosure, the only moving parts in the handle and/or the weight plates may be a connector that is engageable using the selector connected to the base. This may help to reduce manufacturing costs, increase the ease of repair for the adjustable kettlebell, and increase the modularity of the adjustable kettlebell.

Figure 1:
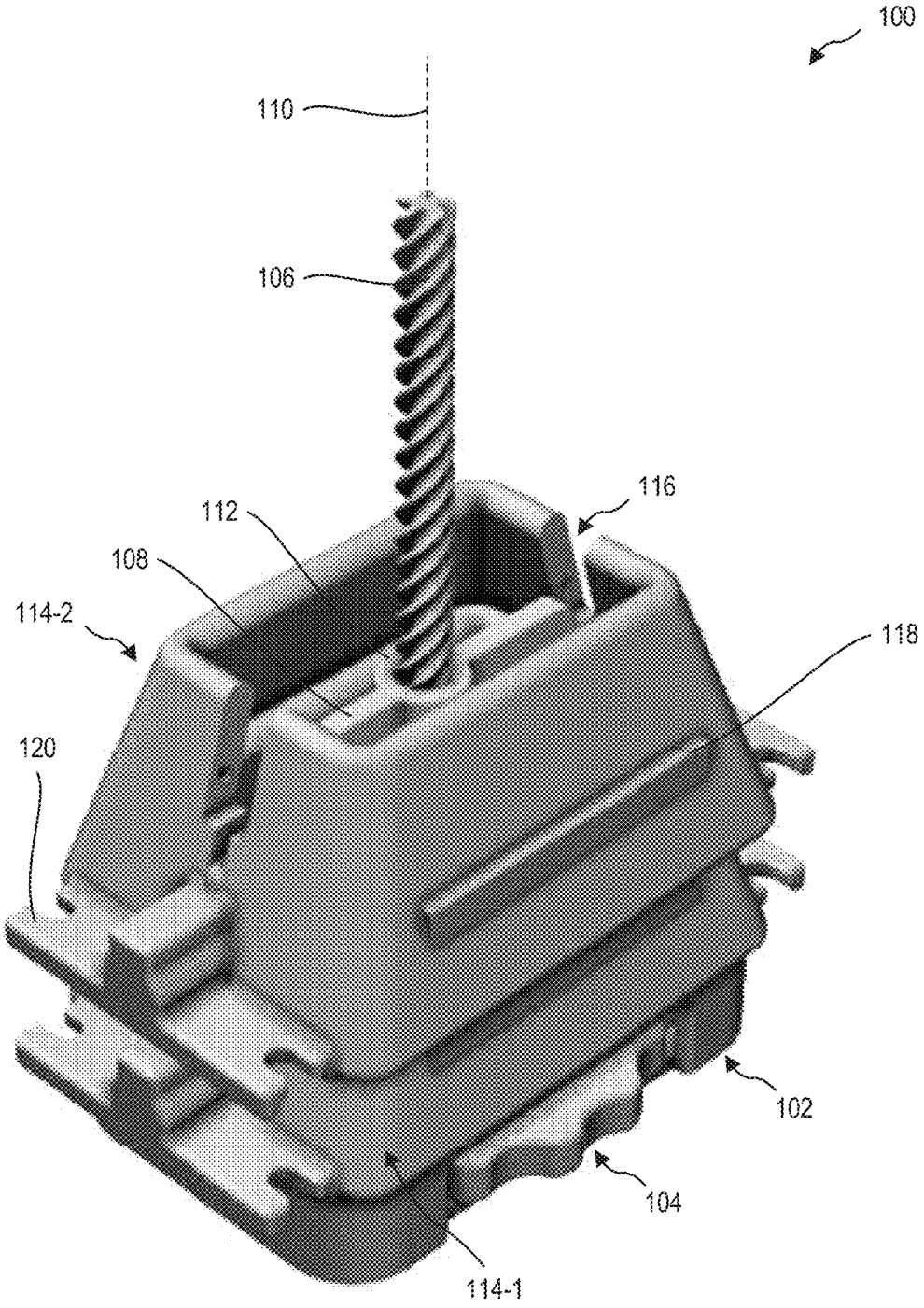
FIG. 1-1 is a perspective view of an adjustable kettlebell system, according to at least one embodiment of the present disclosure.

FIG. 1-1 is a representation of an adjustable kettlebell system 100, according to at least one embodiment of the present disclosure. The adjustable kettlebell system 100 includes a base 102. It should be understood that the base 102 may be any type of base, such as a cradle, a platform, a bench, any other base, and combinations thereof. The base 102 includes a selection mechanism 104, which may be used to adjust a weight of an adjustable kettlebell. The selection mechanism 104 may include a rod 106 (e.g., a selection rod, a threaded rod, a drive shaft). A selector 108 may be connected to the rod 106.

The selector 108 may be movable along a length of the rod 106. For example, the rod 106 may include a longitudinal axis 110, and the selector 108 may be movable along the longitudinal axis 110 of the rod 106. In some embodiments, the rod 106 may be threaded along its outer surface. The selector 108 may include a bore 112. The rod 106 may extend through the bore 112 of the selector 108. The bore 112 may have threads located on its inner surface which are complementary to the threads on the outer surface of the rod 106. Thus, as the rod 106 is rotated relative to the selector 108 (and/or as the selector 108 is rotated relative to the rod 106), the threaded connection between the rod 106 and the selector 108 may cause the selector 108 to move along the length of the rod 106 (e.g., along the longitudinal axis 110). The position of the selector 108 along the length of the rod 106 may determine the operating weight of the adjustable kettlebell.

The rod 106 may extend through a center cavity 116 of one or more weight supports (collectively 114). The selector 108 may be movable through the center cavity 116. The weight supports 114 may support a known amount of weight, such as 1 lb. (0.5 kg), 2 lb. (0.9 kg), 5 lb. (2.3 kg), 10 lb. (4.5 kg), 15 lb. (5.8 kg), 20 lb. (9.1 kg), and so forth. In some embodiments, the cumulative weight of the weight supports 114 plus the supported weight may weigh an amount equal to the known amount. In some embodiments, the supported weight may rest on one or more shoulders 118. In some embodiments, the supported weight may be connected to the weight supports 114 using a bolt, screw, or other mechanical fastener at a connection plate 120. In some embodiments, the weight supports 114 and the supported weight may be separate structures. This may allow the supported weight to be changed and adjusted to suit a user's needs. In some embodiments, the weight supports 114 may be integrally formed with the supported weight such that the weight support 114 weighs the known amount of weight.

In the embodiment shown, the weight supports 114 stack on top of one another. For example, a first weight support 114-1 may rest on the base 102. A second weight support 114-2 may be stacked on top of the first weight support 114-1. The first weight support 114-1 may be partially or fully inserted into the center cavity 116 of the second weight support 114-2. In some embodiments, the second weight support 114-2 may be connected to the first weight support 114-1 in a connected configuration. To disconnect the second weight support 114-2 from the first weight support 114-1, the selector 108 may be moved into the center cavity 116 of the second weight support 114-2. The selector 108 may move a connector (as may be seen in FIG. 2) in the second weight support 114-2 from the connected configuration to the disconnected configuration. This may disconnect the second weight support 114-2 from the first weight support 114-1. In this manner, the weight of the adjustable kettlebell may be changed by selectively connecting and disconnecting weight supports 114 from the underlying weight support. In the embodiment shown, the first weight support 114-1 is underlying or underlies the second weight support 114-2.

Figures 1, 2:
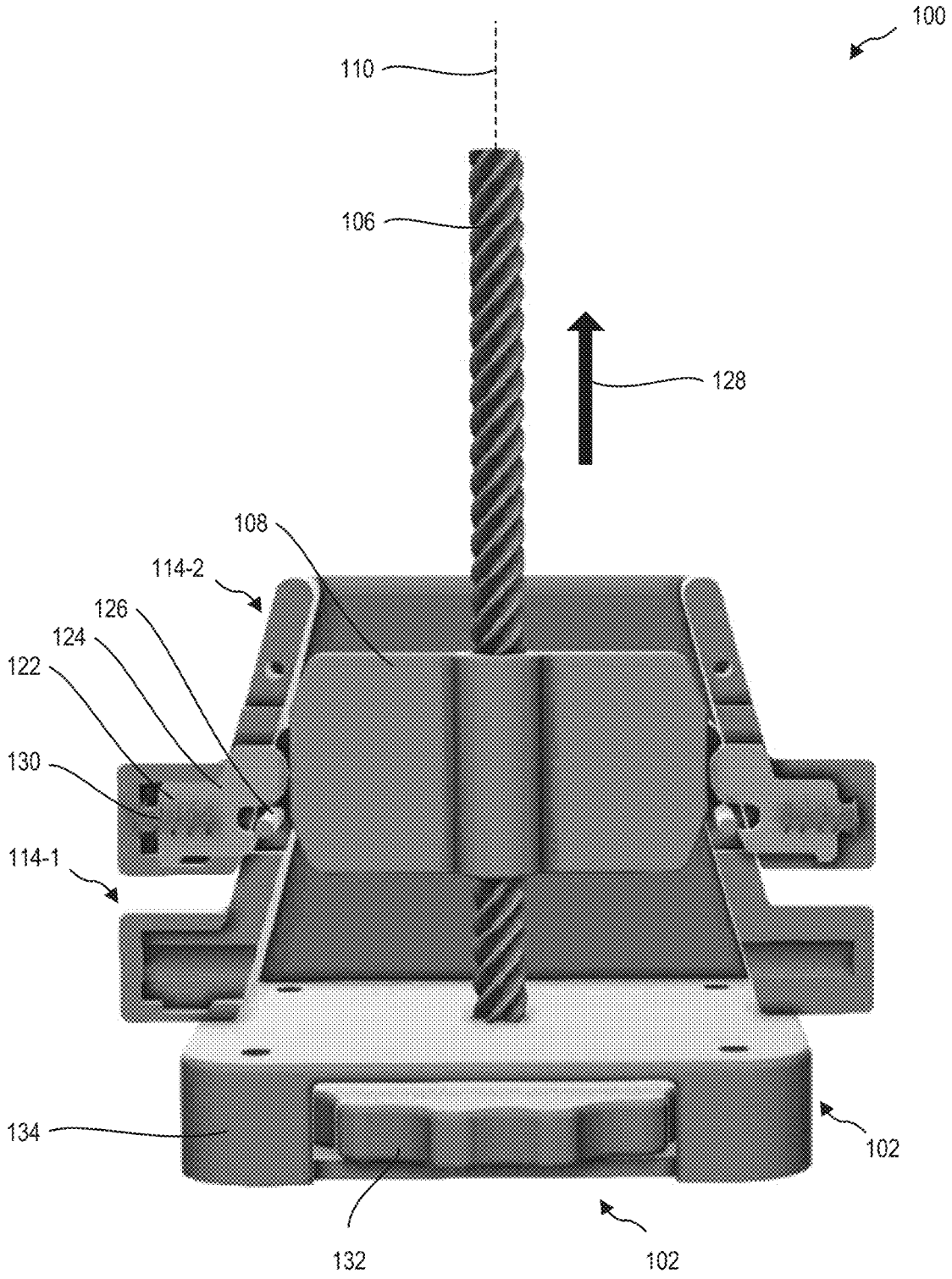

FIG. 1-2 is a cut-away view of the adjustable kettlebell system 100 of FIG. 1-1. As may be seen, the second weight support 114-2 includes a connector 122. The connector 122 may be configured to connect the second weight support 114-2 to the underlying first weight support 114-1 when the second weight support 114-2 is stacked on the first weight support 114-1 (e.g., when the first weight support 114-1 is inserted into the center cavity 116 of the second weight support 114-2). For example, in the embodiment shown, the connector 122 includes a hook 124 that hooks onto a bar 126 of the first weight support 114-1. In the embodiment shown, the first weight support 114-1 is formed from two separate sections, and the bar 126 extends between the first section and second section of the first weight support 114-1. However, it should be understood that the bar 126 may be any structure that may allow the second weight support 114-2 to connect to the first weight support 114-1. For example, the bar 126 may be a ledge, a hook, a magnet, a cable, any other structure, and combinations thereof.

As discussed herein, in the connected position, the hook 124 may interlock with the bar 126 to connect the second weight support 114-2 to the first weight support 114-1. Thus, in the connected configuration, when the second weight support 114-2 is moved out of the base 102 (e.g., when the second weight support 114-2 is moved in an upward direction 128 along the longitudinal axis 110), the connection of the first weight support 114-1 to the connector 122 may pull the first weight support 114-1 out of the base 102. This may increase the weight of the adjustable kettlebell.

While embodiments of the present disclosure show a hook 124 that mechanically interlocks with the bar 126, it should be understood that any type of connection may be formed between the second weight support 114-2 and the first weight support 114-1. For example, the connection may include a magnetic connection, a Velcro connection, a friction fit, an interference fit, a removable adhesive, any other type of connections, and combinations thereof.

In the embodiment shown, the selector 108 has pushed the connector 122 in the second weight support 114-2 into the disconnected position. In the disconnected position, the hook 124 is moved away from the bar 126 so that, when the second weight support 114-2 is moved in the upward direction 128, the hook 124 may not be connected to the bar 126, and the first weight support 114-1 may remain on the base 102. In this manner, the weight of the adjustable kettlebell may be reduced by placing the connector 122 in the disconnected position, thereby disconnecting the first weight support 114-1 from the second weight support 114-2.

In some embodiments, the connector 122 may move in a transverse direction to the longitudinal axis 110 (e.g., a direction transverse to the length of the rod 106). In this manner, the hook 124 may selectively engage the bar 126, based on the distance of the connector 122 from the bar 126. In some embodiments, the connector 122 may be biased toward the bar 126. In this manner, when the selector 108 is not pushing the connector 122 away from the bar 126, the second weight support 114-2 may be connected to the first weight support 114-1. In some embodiments, the connector 122 may be biased toward the bar 126 by a biasing element 130. The biasing element 130 may be any biasing element, such as a spring (e.g., a coil spring, a Belleville washer, a wave spring, a leaf spring), a gas piston, an elastically compressible material, a magnetic biasing element, any other biasing element, and combinations thereof.

While embodiments of the present disclosure show or describe the connector 122 as moving transverse to the rod 106, it should be understood that the connector 122 may move in any direction to connect or disconnect the weight supports 114. For example, the connector 122 may rotate to engage or disengage the connector 122. In some embodiments, the axis may be parallel to the longitudinal axis 110, but offset from the longitudinal axis 110. In some embodiments, the axis may be transverse to the longitudinal axis 110. In some embodiments, the connector 122 may move in a direction parallel to the longitudinal axis 110.

To move the connector 122 between the connected position or configuration and the disconnected position or configuration, the rod 106 may be rotated relative to the selector 108. Because the rod 106 and the selector 108 are connected with a rotatable connection, rotating the rod 106 may cause the selector 108 to move along the longitudinal axis 110. In some embodiments, the orientation of the selector 108 may be maintained while the rod 106 is rotating. For example, the selector 108 may be prevented from rotating with the rod 106 by the inner surface of the weight supports 114. In some embodiments, the selector 108 may be housed in a selector housing that is configured to prevent movement of the selector. The selector housing may extend through the center cavity 116 of the weight supports 114.

As discussed herein, as the selector 108 moves along the longitudinal axis 110, the selector 108 may contact the connector 122 and push the connector 122 away from the bar 126. In this manner, the selector 108 may move the connector 122 from the connected position to the disconnected position.

In the embodiment shown, the second weight support 114-2 includes two connectors 122 located on opposite sides of the rod 106. However, it should be understood that the weight supports 114 may include any number of connectors 122, including 1, 2, 3, 4, 5, 6, 7, 8, 9, 10, or more connectors. The number of connectors may be selected based on stability, strength, and other factors.

In some embodiments, the rod 106 may be rotated using a rotation mechanism 132. In the embodiment shown, the rotation mechanism 132 is a dial or a drive gear. The dial extends out of the housing 134 of the base 102. In some embodiments, the dial may be rotated by a user's hand. The dial may include one or more markings associated with a connected weight of the adjustable kettlebell. The markings may be associated with a rotational position of the rod 106, which may, in turn, be associated with a position of the selector 108 along the rod 106. In this manner, the user may adjust the weight of the adjustable kettlebell by rotating the dial until the marking associated with the desired weight is selected.

In some embodiments, the rotation mechanism 132 (e.g., drive gear(s)) may be powered by an electric motor. The electric motor may be connected to the rotation mechanism 132, such as by a geared connection and/or a belt or chain. The electric motor may rotate the rotation mechanism 132, thereby causing the rod 106 to rotate, and the rotation of the rod 106 may cause the selector 108 to move along the longitudinal axis 110. As discussed herein, in some embodiments, the position of the selector 108 may be determined using one or more position sensors on the selector 108, a rotational position of the rod 106, position sensors on the connector 122, any other way, and combinations thereof.

In accordance with embodiments of the present disclosure, the selection mechanism 104 (e.g., selection mechanism 104 in FIG. 1-1) for the adjustable kettlebell may be primarily located in and/or connected to the base 102. The only moving parts of the selection mechanism 104 may be the connector 122 and the biasing element 130. This may help to simplify the construction of the adjustable kettlebell. Conventional adjustable kettlebells have a complex selection mechanism located in the handle of the kettlebell. However, kettlebells are often used dynamically, and are subject to dropping, jarring, hitting walls, floors, ceilings, and other surfaces. This contact may cause damage to a selection mechanism, especially over time and repeated contact. By limiting the moving parts within the handle and/or weight plates, the reliability and/or operational lifetime of the adjustable kettlebell may be greatly increased.

Furthermore, by including the selection mechanism 104 in the base 102, the manufacturing of the weight supports 114 and/or the handle may be simplified, thereby reducing costs. This may further allow for the modification and/or substitution of various parts of the adjustable kettlebell. This may save the user money by increasing the modularity of the adjustable kettlebell.

FIG. 2-1 through FIG. 2-7 are a sequential representation of adjusting an adjustable kettlebell 236, according to at least one embodiment of the present disclosure. In the position shown in FIG. 2-1, the adjustable kettlebell 236 is removed from the base 202. The adjustable kettlebell 236 includes a handle 238. The handle 238 is connected to a plurality of weight supports (collectively 214). Each weight support 214 is connected to its underlying weight support 214 with a connector (collectively 222). For example, and as discussed herein with respect to FIG. 1-2, a second weight support 214-2 is connected to a first weight support 214-1 with a second connector 222-2. A third weight support 214-3 is connected to the second weight support 214-2 with a third connector 222-3. A fourth weight support 214-4 is connected to the third weight support 214-3 with a fourth connector 222-4. The handle 238 is connected to the fourth weight support 214-4 with a handle connector 222-5. The first weight support 214-1 is the lowest weight support 214-1 and the first connector 222-1 is not connected to any other weight support.

The connected weight of the adjustable kettlebell 236 is the combined weight of the handle 238 and any connected weight supports 214 and associated weight plates. For example, if the handle 238 weighs 10 lb., and each weight support 214 and associated weight plates weight 10 lb., then the combined weight of the adjustable kettlebell 236 shown in FIG. 2-1 is 50 lb. As discussed herein, it should be understood that the weight of the weight supports 214 and/or associated weight plates may be adjusted to add more or less weight to the adjustable kettlebell 236 when connected to the weight supports 214.

During use, the adjustable kettlebell 236 may be removed or separated from the base 202. After an exercise activity (such as a weight lifting set of a series of repeated motions), the user may place the adjustable kettlebell in the base 202 (e.g., in the cradle). For example, the user may place the adjustable kettlebell 236 on the base so that the first weight support 214-1 is resting on the base 202, as may be seen in FIG. 2-2.

In the view shown in FIG. 2-2, as the adjustable kettlebell 236 is placed on the base 202, the selector 208 may contact or engage the first connector 222-1. This may push the first connector 222-1 away from the rod 206. In some embodiments, the first weight support 214-1 may not include a first connector 222-1. In some embodiments, the first connector 222-1 may engage with or connect to a bar that is connected to the base 202. In this manner, the first connector 222-1 may stay connected to the base 202 when the handle 238 is removed from the base 202 during an exercise activity.

In accordance with embodiments of the present disclosure, to adjust the connected weight of the adjustable kettlebell 236, the user may input a desired weight into the adjustable kettlebell system 200. For example, the user may adjust a dial on the base 202, input the desired weight into an input on the base 202, input the desired weight into a remote computing device, or otherwise input a desired weight. To adjust the connected weight of the adjustable kettlebell 236, the adjustable kettlebell system 200 may move the selector 208 along the length of the rod 206. For example, the adjustable kettlebell system 200 may rotate the rod 206, which may be connected to the selector 208 with a threaded connection. Rotation of the rod 206 may cause the selector 208 to move along the length of the rod 206.

Figures 1, 2:
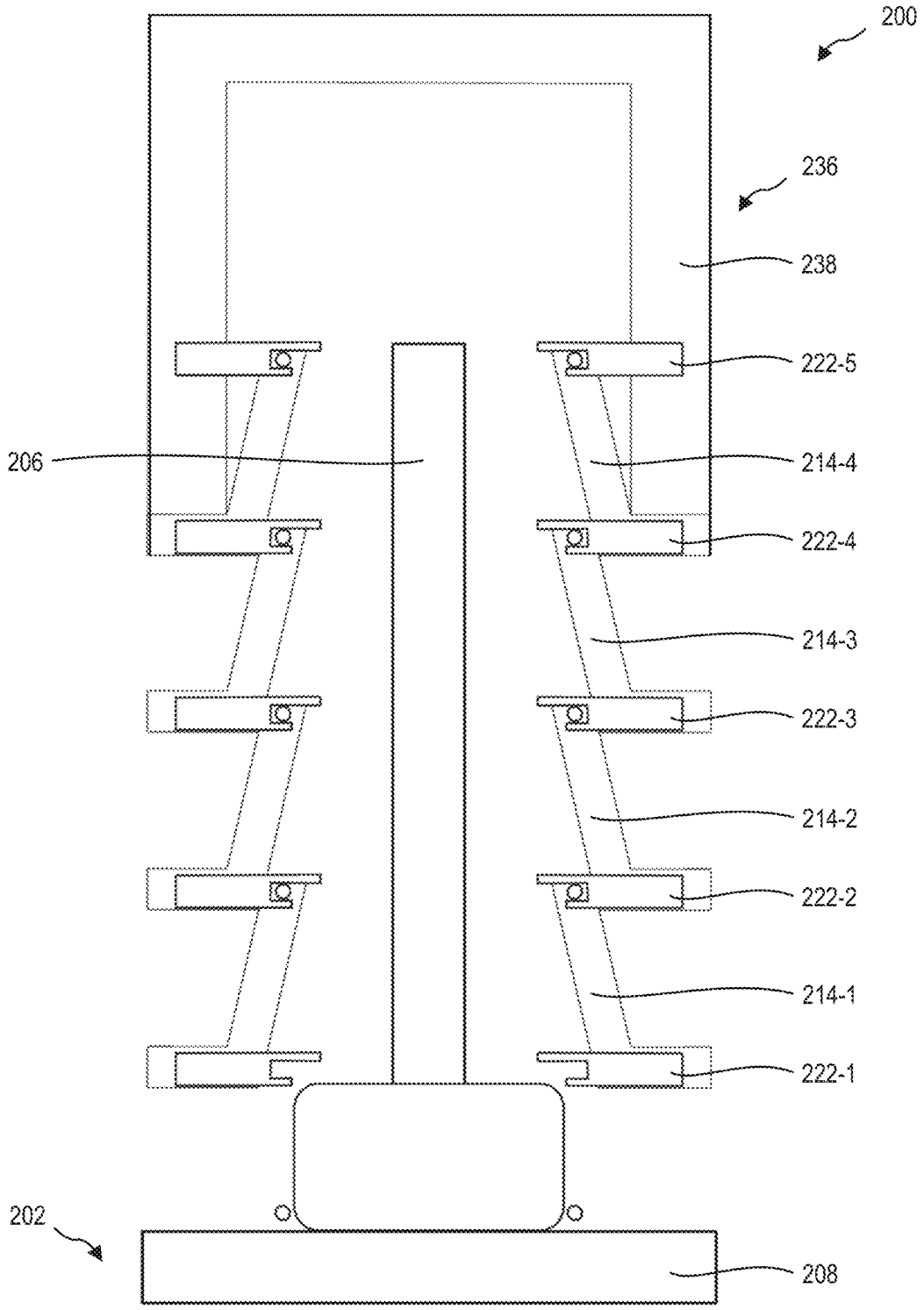
Figure 2:
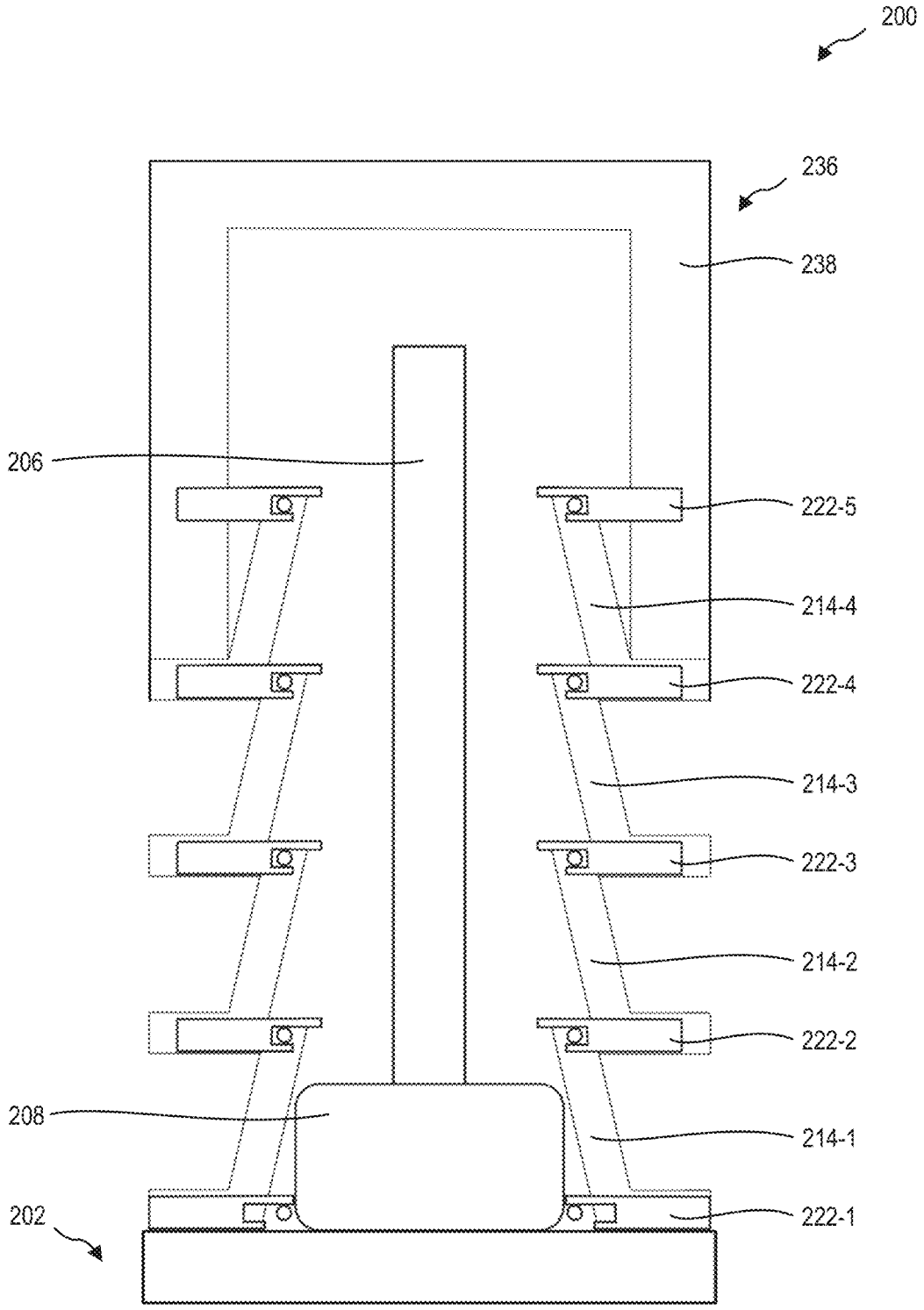
Figures 2, 3:
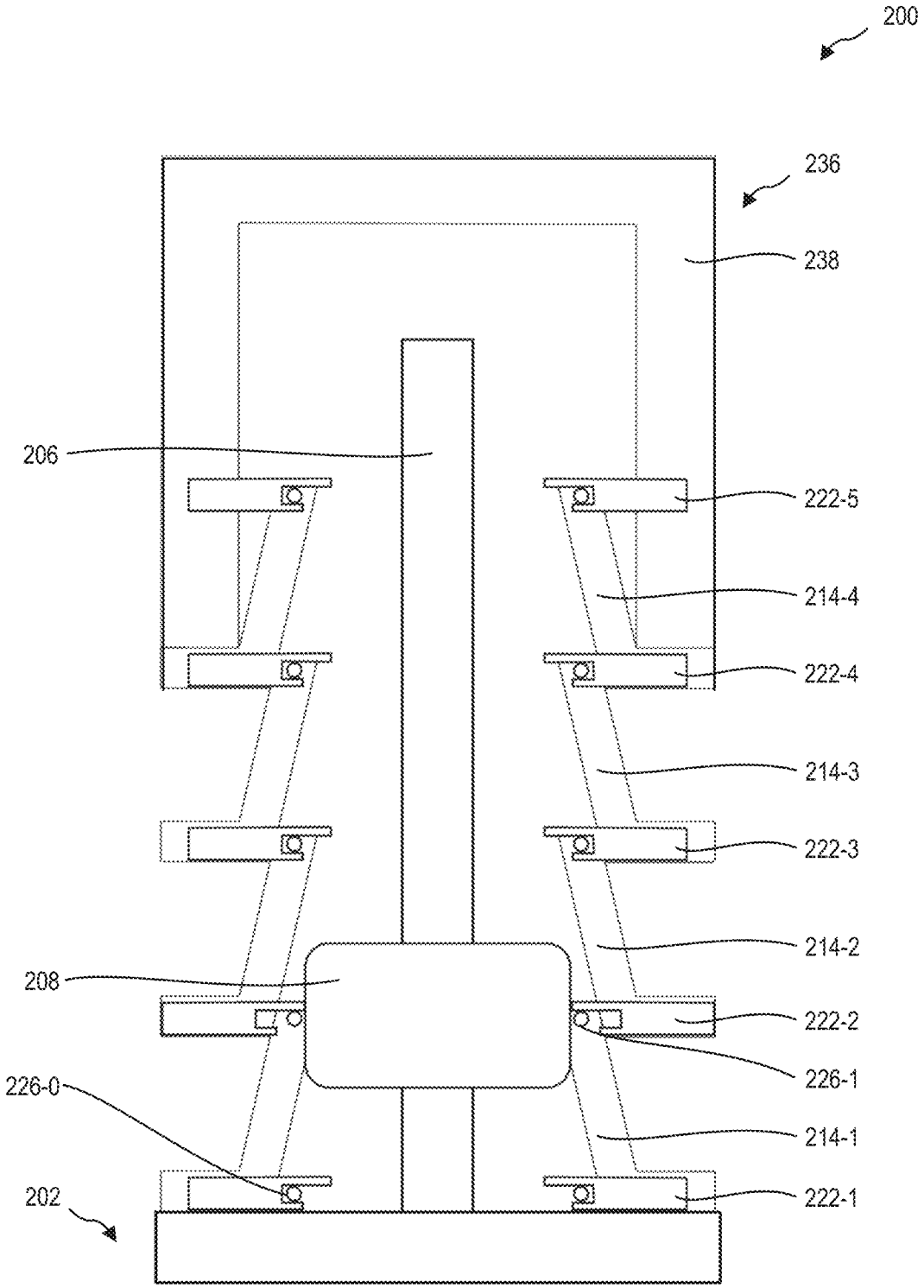

In some embodiments, the rod 206 may be rotated such that the selector 208 moves from the first engagement position shown in FIG. 2-2 to the second engagement position shown in FIG. 2-3. As discussed herein, the connectors 222 may be biased toward the rod 206. As the selector 208 moves from the first engagement position to the second engagement position, the first connector 222-1 may move toward the rod 206. In some embodiments, the first connector 222-1 may engage with a base bar 226-0. The base bar 226-0 may be connected to the base 202, thereby securing the first weight support 214-1 to the base 202.

As the selector 208 moves up the length of the rod 206 into the second engagement position shown in FIG. 2-3, the selector 208 may engage the second connector 222-2. The selector 208 may push or urge the second connector 222-2 away from the rod 206. This may cause the second connector 222-2 to disengage from the first bar 226-1. Put another way, the hook of the second connector 222-2 may be moved away from the second bar 226-2 such that, when the second weight support 214-2 is moved upward, the second connector 222-2 may not engage with the first bar 226-1, and the second weight support 214-2 may be separated from the first weight support 214-1.

Figures 2, 3, 4:
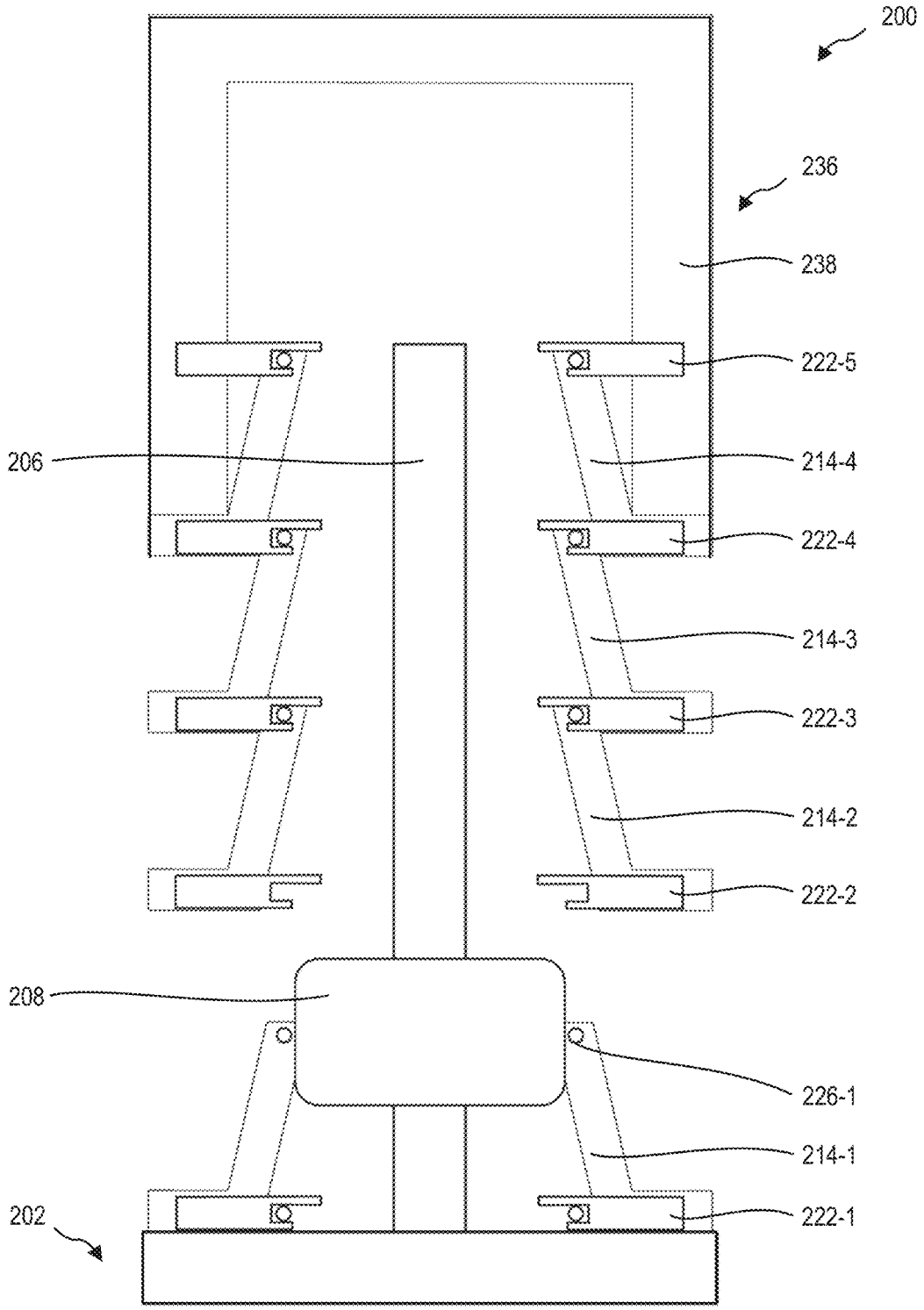

The user may then remove the adjustable kettlebell 236 from the base 202, as may be seen in FIG. 2-4. As may be seen in FIG. 2-4, when the adjustable kettlebell 236 has been removed from the base 202, the handle 238 is connected to the fourth weight support 214-4, which is connected to the third weight support 214-3, which is connected to the second weight support 214-2. The first weight support 214-1 may remain connected to or secured to the base 202. In this manner, the connected weight of the adjustable kettlebell 236 may be changed. For example, if the handle 238 and each of the weight supports 214 and associated weight plates weigh 10 lb., the connected weight of the adjustable kettlebell 236 shown in FIG. 2-4 may be 40 lb.

As discussed herein, because the first connector 222-1 is connected to the base bar 226-0, the first weight support 214-1 may be connected to the base 202. This may help prevent the first weight support 214-1 from being misplaced, dropped, damaged, or otherwise inadvertently removed from the base 202.

Each of the weight supports 214 may be selectively engaged or disengaged from the underlying weight support 214. In this manner, the connected weight of the adjustable kettlebell 236 may be selectively adjusted or changed. This may reduce the amount of equipment that a user, gym, or other individual or group may purchase or utilize. This may further reduce the surface footprint of the user's exercise equipment.

As may be seen in FIG. 2-5, to further adjust the connected weight of the adjustable kettlebell 236, the selector 208 may be moved to the third engagement position shown. In the third engagement position, the selector 208 pushed the third connector 222-3 away from the second bar 226-2. When the handle 238 was removed from the base 202, the third weight support 214-3 was disengaged from the second weight support 214-2. The handle 238 may remain connected to the fourth weight support 214-4, which may remain connected to the third weight support 214-3. Thus, in the view shown, the connected weight of the adjustable kettlebell 236 may be 30 lb.

As may be seen in FIG. 2-6, when the selector 208 is moved into the fourth engagement position, the fourth connector 222-4 may be disengaged from the third bar 226-3, thereby allowing the fourth weight support 214-4 to be disconnected from the third weight support 214-3. The handle 238 may be connected to the fourth weight support 214-4. Thus, in the view shown, the connected weight of the adjustable kettlebell 236 may be 20 lb.

As may be seen in FIG. 2-7, when the selector 208 is moved into the fifth engagement position shown, the handle connector 222-5 may be disengaged from the fourth bar 226-4. This may allow the handle 238 to be disconnected from the fourth weight support 214-4. In this manner, when the handle 238 is removed from the base 202, the handle 238 may not be connected to any of the weight supports 214. Thus, in the view shown, the connected weight of the adjustable kettlebell 236 may be 10 lb.

As may be seen in FIG. 2-1 through FIG. 2-7, the adjustable kettlebell system 200 may selectively adjust the connected weight of the adjustable kettlebell 236. This may allow the user to perform exercise activities with a desired amount of connected weight. This may further increase the versatility of the user's exercise equipment.

In some embodiments, the rod 206 may be rotated at the base 202. This may reduce the complexity of the adjustment mechanism of the adjustable kettlebell 236. For example, as discussed herein, the adjustable kettlebell 236 may be subject to drops, bumps, jostles, and so forth. This may improve the reliability of the adjustable kettlebell system 200.

FIG. 3 is a representation of an adjustable kettlebell system 300, according to at least one embodiment of the present disclosure. In some embodiments, a motor 340, such as an electric motor, may be located in the base 302. The motor 340 may be connected to the rod 306 in the base 302. The motor 340 may rotate the rod 306. As discussed herein, as the motor 340 rotates the rod 306, the rotation of the rod 306 may cause the selector 308 to move along the length of the rod 306. In some embodiments, the motor 340 may be directly connected to the selector 308. For example, the motor 340 may be a linear motor or a piston, and the motor 340 may directly move the selector 308 along the length of the rod 306.

In some embodiments, the rod 306 may be rotatable by a rotation mechanism 332 (e.g., drive gear(s)). The drive gear may be fixedly or rigidly connected to the rod 306. In some embodiments, the rotation mechanism 332 may be rotatable by hand. For example, the rotation mechanism 332 may extend out of the housing of the base 302, and the user may manually rotate the rotation mechanism 332 to rotate the rod 306. In some embodiments, the rotation mechanism 332 may be rotated using the motor 340. For example, the motor 340 may be connected to the rotation mechanism 332 with a belt 341, cable, chain, or other connector. The motor 340 may rotate the belt 341, which may then rotate the rotation mechanism 332. In some embodiments, the motor 340 may be connected to the rotation mechanism 332 with a geared connection.

In some embodiments, the adjustable kettlebell system 300 may include one or more sensors that may determine the connected weight of the adjustable kettlebell 336. For example, the rod 306 may include a rotational position sensor 342 to sense the rotational position of the rod 306. The rotational position of the rod 306 may be associated with the position of the selector 308. By understanding the rotational position of the rod 306, the position of the selector 308 along the length of the rod 306 may be inferred. In this manner, the adjustable kettlebell system 300 may determine in which engagement position the selector 308 is located (e.g., the first engagement position, the second engagement position, the third engagement position, the fourth engagement position, or the fifth engagement position, as seen in FIG. 2-1 through FIG. 2-7). In some embodiments, the motor 340 may include a rotational position sensor to sense the rotational position of the motor 340, and therefore the rotational position of the rod 306.

In some embodiments, the rod 306 and the selector 308 may include sensors to determine the position of the selector 308 on the rod 306. For example, the rod 306 may include a rod sensor 344-1 and the selector 308 may include a selector sensor 344-2. When the rod sensor 344-1 senses the selector sensor 344-2, the adjustable kettlebell system 300 may determine the position of the selector 308. The connected weight of the adjustable kettlebell 336 may then be determined based on the position of the selector 308 on the rod 306. In some embodiments, each of the connectors 322 may include a connector position sensor 346. The connector position sensor 346 may determine whether the connector 322 is located in the connected position or the disconnected position. The connected weight of the adjustable kettlebell 336 may be determined based on which connector 322 is located in the disconnected position.

FIG. 4 is a representation of an adjustable kettlebell system 400, according to at least one embodiment of the present disclosure. The adjustable kettlebell system 400 includes an exercise program manager 448. The exercise program manager 448 may implement an exercise program. The exercise program may include one or more exercise activities which may utilize an adjustable kettlebell. The exercise activities may be performed using different connected weights of the adjustable kettlebell.

When an exercise activity utilizes a different connected weight, the exercise program manager 448 may instruct a selection mechanism 450 to adjust the connected weight of the adjustable kettlebell. In some embodiments, the selection mechanism 450 may cause a motor 452 to rotate a rod (e.g., the rod 206 of FIG. 2-1 through FIG. 2-7). Rotation of the rod may cause a selector (e.g., the selector 208 of FIG. 2-1) to move along the length of the rod. The selector may engage with one or more connectors (e.g., the connectors 222 of FIG. 2-1 through FIG. 2-7) of the weight plates (e.g., the weight supports 214 of FIG. 2-1 through FIG. 2-7). This may cause the weight support to be disengaged from the underlying weight support. In this manner, the selection mechanism 450 may change the connected weight of the adjustable kettlebell based on the particular exercise activity identified by the exercise program manager 448.

In some embodiments, the kettlebell system 400 may include a communication port 454. The communication port 454 may receive communications from a remote computing device. In some embodiments, the remote computing device may transmit one or more exercise programs to the kettlebell system 400. For example, the communication port 454 may receive one or more exercise programs from an exercise server. The communication port 454 may communicate the received exercise programs to be implemented by the exercise program manager 448.

In some embodiments, the communication port 454 may receive information from a commercially managed exercise server. A user may receive one or more commercially prepared exercise programs that are transmitted from the exercise server. In some embodiments, the communication port 454 may receive information from a mobile device, such as a smart phone or tablet. A user may develop his or her own exercise program on the mobile device and transmit it to the communication port 454. In some embodiments, the user may instruct the selection mechanism 450 to change the connected weight of the adjustable kettlebell through the mobile device.

In some embodiments, the kettlebell system 400 may include an input device 456. The input device 456 may allow a user to adjust the connected weight of the adjustable kettlebell and/or implement an exercise program. In some embodiments, the input device 456 may include a dial, and the user may rotate the dial to select a desired weight. In some embodiments, the input device 456 may include one or more buttons, such as a keyboard, a keypad, a number pad, a touchscreen, and so forth. The user may press a button or series of buttons associated with a particular connected weight of the adjustable kettlebell. In some embodiments, the input device 456 may include a microphone and voice recognition software. The user may speak one or more commands, which the voice recognition software may recognize as an instruction to perform an activity. For example, the user may provide an instruction to change the connected weight of the adjustable kettlebell, implement an exercise program, and so forth.

In some embodiments, the kettlebell system 400 may include one or more sensors 458. The selection mechanism 450 may utilize the one or more sensors 458 to determine the connected weight of the adjustable kettlebell. For example, a rotational sensor 460 may sense a rotational position of the rod, and the rotational position may be used to infer the position of the selector. In some embodiments, a rod sensor 462 on the rod, with an associated selector sensor on the selector, may determine the position of the selector on the rod sensor 462. The position of the selector on the rod may then be used to infer the connected weight of the adjustable kettlebell. In some embodiments, the connectors on the weight supports may include one or more connector sensors 464. The connector sensors 464 may determine whether a connector of a particular weight support is in the connected position or the disconnected position. The connected weight of the adjustable kettlebell may be inferred based on which connector is in the disconnected position.

Figures 2, 3, 4, 5:
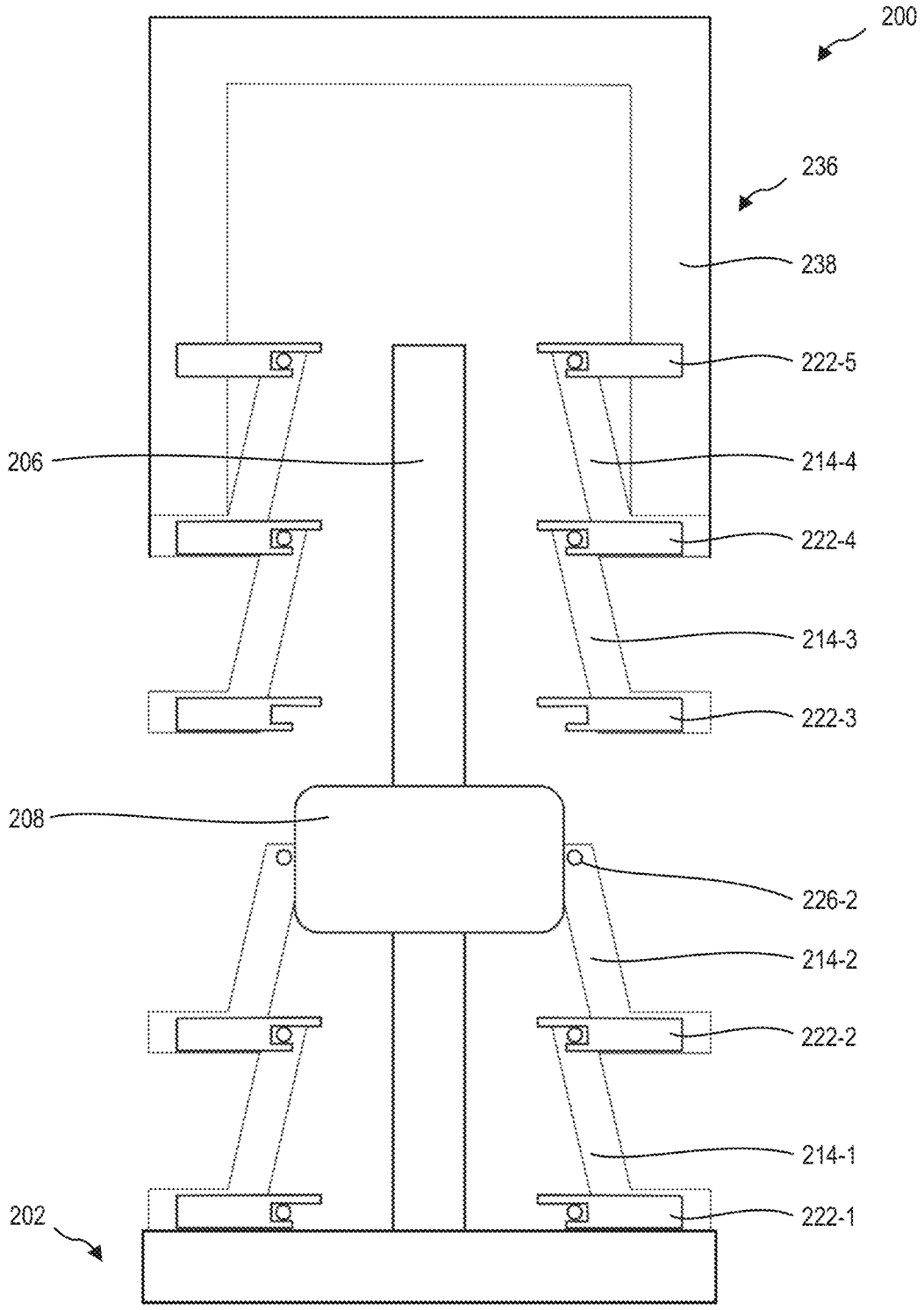
Figures 2, 3, 4, 5, 6:
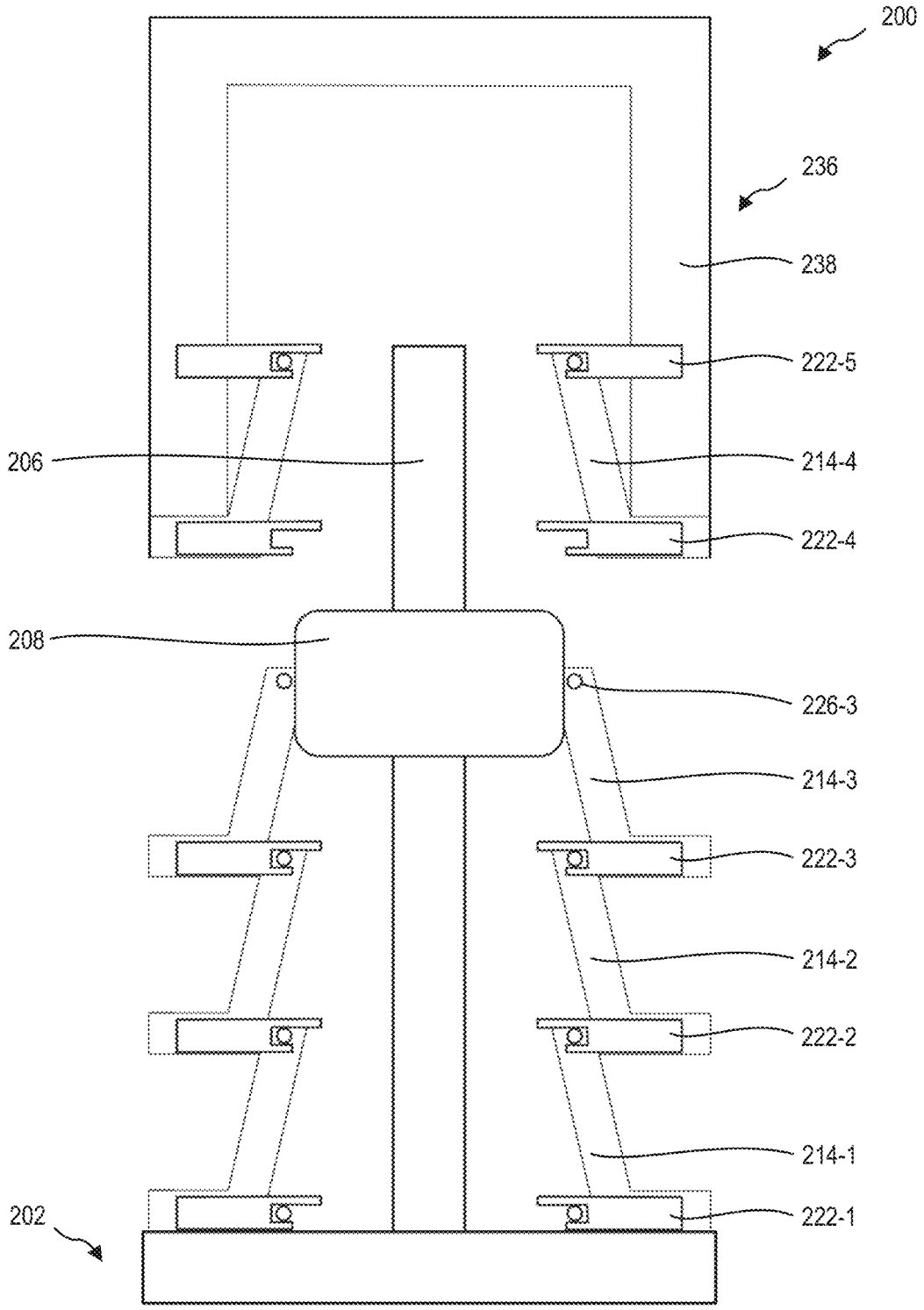
Figures 2, 3, 4, 5, 6, 7:
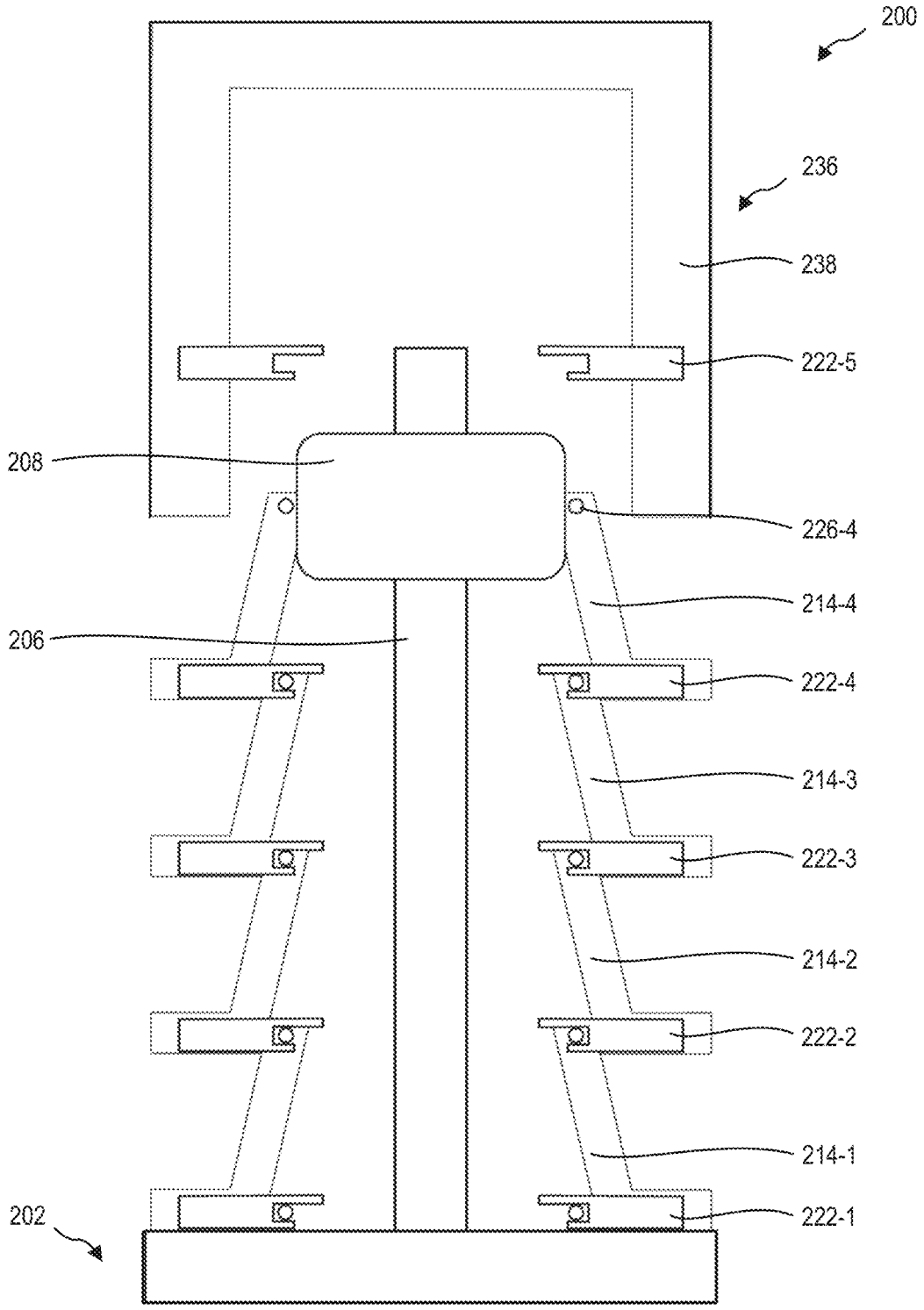
Figure 3:
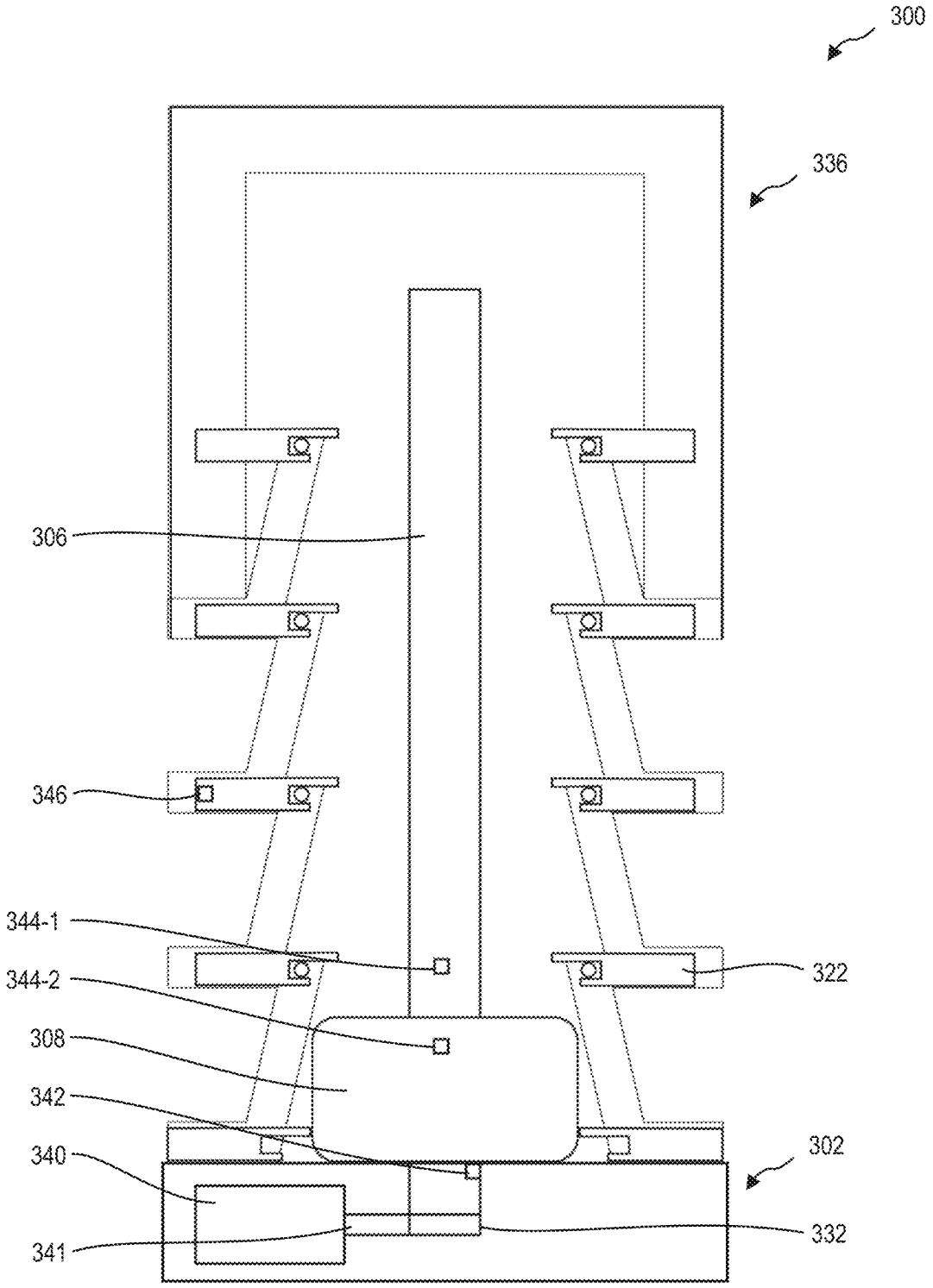
Figure 4:
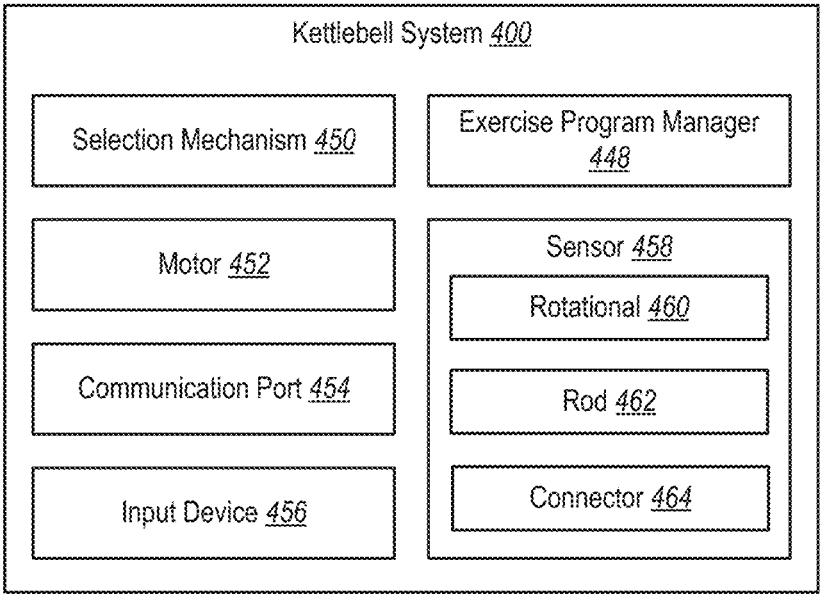
Figure 5:
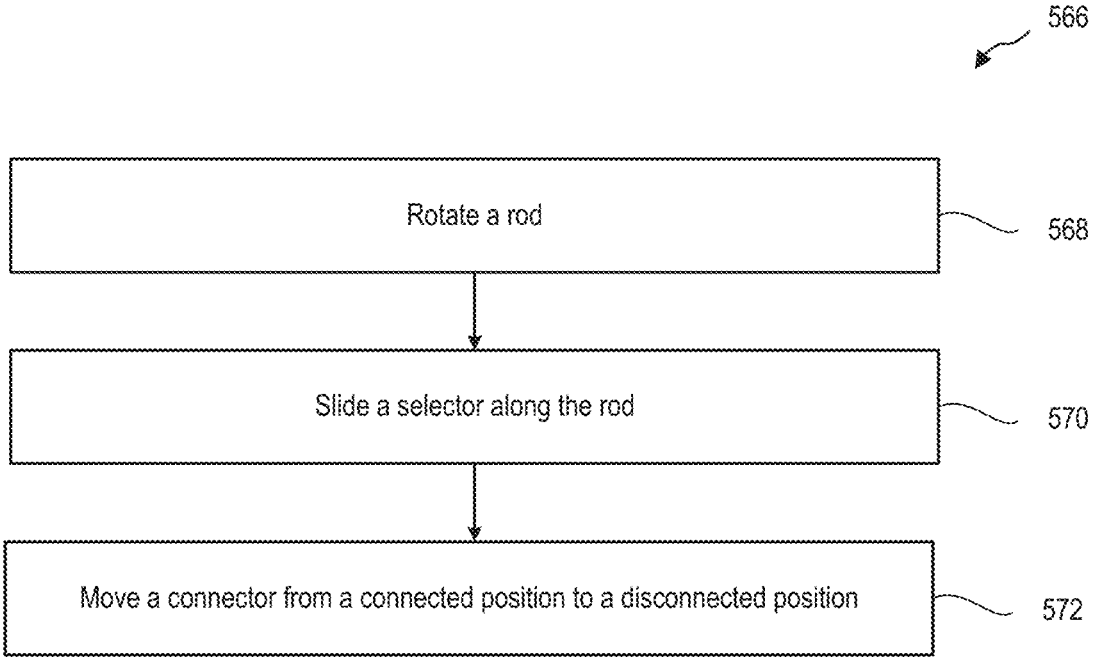

FIG. 5 is a flowchart of a method 566 for adjusting a weight of an adjustable kettlebell, according to at least one embodiment of the present disclosure. The method 566 includes rotating a rod at 568. The rod is connected to the base or cradle of an adjustable kettlebell system. The rod may extend through an adjustable kettlebell. For example, the rod may extend through the center cavity of a plurality of weight plates. Each weight plate may be connected to a weight support, and the rod may extend through the weight support. In some embodiments, based on rotating the rod, a selector may be slid along the rod at 570. As the selector slides along the rod, the selector may engage a connector in the weight supports. The connector may be moved from a connected position to a disconnected position at 572. Moving the connector from the connected position to the disconnected position may cause the weight support or the weight plate to be disconnected or disengaged from the underlying weight plate or weight support. Moving the selector to engage with a particular connector of a particular weight support may allow the user to adjust the connected weight of the adjustable kettlebell.

In some embodiments, the method 566 may include receiving an input to change the connected weight of the adjustable kettlebell. In some embodiments, the input may be received from an exercise program. In some embodiments, the input may be received from a user input. The user input may be received from a remote device. In some embodiments, the user input may be received from an input device on the adjustable kettlebell or the base.

INDUSTRIAL APPLICABILITY

This disclosure generally relates to devices, systems, and methods for adjustable kettlebell systems. An adjustable kettlebell system includes a motor in a base of the cradle. The motor may spin a threaded rod that is connected to the base. A selector may be threaded onto the rod. As the motor spins the rod, the selector may travel along the length of the rod. Several weight supports are stacked on the base so that the rod extends through the weight supports. A connector located in the weight supports connects each weight support to the underlying weight support. The selector may contact or engage the connector, thereby disconnecting the weight support from the underlying weight support. By selectively disconnecting weight supports, the weight of the kettlebell may be adjusted.

The selection mechanism of the present disclosure may be included primarily in the cradle of the adjustable kettlebell. This may simplify the construction of the handle and/or the weight plates. In accordance with embodiments of the present disclosure, the only moving parts in the handle and/or the weight plates may be a connector that is engageable using the selector connected to the base. This may help to reduce manufacturing costs, increase the ease of repair for the adjustable kettlebell, and increase the modularity of the adjustable kettlebell.

In some embodiments, an adjustable kettlebell system includes a base. The base may be any type of base, such as a cradle, a platform, a bench, any other base, and combinations thereof. The base includes a selection mechanism, which may be used to adjust a weight of an adjustable kettlebell. The selection mechanism may include a rod (e.g., a selection rod, a threaded rod, a drive shaft). A selector may be connected to the rod.

The selector may be movable along a length of the rod. For example, the rod may include a longitudinal axis, and the selector may be movable along the longitudinal axis of the rod. In some embodiments, the rod may be threaded along its outer surface. The selector may include a bore. The rod may extend through the bore of the selector. The bore may have threads located on its inner surface which are complementary to the threads on the outer surface of the rod. Thus, as the rod is rotated relative to the selector (and/or as the selector is rotated relative to the rod), the threaded connection between the rod and the selector may cause the selector to move along the length of the rod (e.g., along the longitudinal axis). The position of the selector along the length of the rod may determine the operating weight of the adjustable kettlebell.

The rod may extend through a center cavity of one or more weight supports. The selector may be movable through the center cavity. The weight supports may support a known amount of weight, such as 1 lb. (0.5 kg), 2 lb. (0.9 kg), 5 lb. (2.3 kg), 10 lb. (4.5 kg), 15 lb. (5.8 kg), 20 lb. (9.1 kg), and so forth. In some embodiments, the cumulative weight of the weight supports plus the supported weight may weigh an amount equal to the known amount. In some embodiments, the supported weight may rest on one or more shoulders. In some embodiments, the supported weight may be connected to the weight supports using a bolt, screw, or other mechanical fastener at a connection plate. In some embodiments, the weight supports and the supported weight may be separate structures. This may allow the supported weight to be changed and adjusted to suit a user's needs. In some embodiments, the weight supports may be integrally formed with the supported weight such that the weight support weighs the known amount of weight.

In the embodiment shown, the weight supports stack on top of one another. For example, a first weight support may rest on the base. A second weight support may be stacked on top of the first weight support. The first weight support may be partially or fully inserted into the center cavity of the second weight support. In some embodiments, the second weight support may be connected to the first weight support in a connected configuration. To disconnect the second weight support from the first weight support, the selector may be moved into the center cavity of the second weight support. The selector may move a connector in the second weight support from the connected configuration to the disconnected configuration. This may disconnect the second weight support from the first weight support. In this manner, the weight of the adjustable kettlebell may be changed by selectively connecting and disconnecting weight supports from the underlying weight support. In the embodiment shown, the first weight support is underlying or underlies the second weight support.

In some embodiments, a second weight support includes a connector. The connector may be configured to connect the second weight support to the underlying first weight support when the second weight support is stacked on and the first weight support (e.g., when the first weight support is inserted into the center cavity of the second weight support). For example, in the embodiment shown, the connector includes a hook that hooks onto a bar of the first weight support. In some embodiments, the first weight support is formed from two separate sections, and the bar extends between the first section and second section of the first weight support. However, it should be understood that the bar may be any structure that may allow the second weight support to connect to the first weight support. For example, the bar may be a ledge, a hook, a magnet, a cable, any other structure, and combinations thereof.

As discussed herein, in the connected position, the hook may interlock with the bar to connect the second weight support to the first weight support. Thus, in the connected configuration, when the second weight support is moved out of the base (e.g., when the second weight support is moved in an upward direction along the longitudinal axis), the connection of the first weight support to the connector may pull the first weight support out of the base. This may increase the weight of the adjustable kettlebell.

While embodiments of the present disclosure may discuss a hook that mechanically interlocks with the bar, it should be understood that any type of connection may be formed between the second weight support and the first weight support. For example, the connection may include a magnetic connection, a Velcro connection, a friction fit, an interference fit, a removable adhesive, any other type of connections, and combinations thereof.

In some embodiments, the selector has pushed the connector in the second weight support into the disconnected position. In the disconnected position, the hook is moved away from the bar so that, when the second weight support is moved in the upward direction, the hook may not be connected to the bar, and the first weight support may remain on the base. In this manner, the weight of the adjustable kettlebell may be reduced by placing the connector in the disconnected position, thereby disconnecting the first weight support from the second weight support.

In some embodiments, the connector may move in a transverse direction to the longitudinal axis (e.g., a direction transverse to the length of the rod). In this manner, the hook may selectively engage the bar, based on the distance of the connector from the rod. In some embodiments, the connector may be biased toward the bar. In this manner, when the selector is not pushing the connector away from the bar, the second weight support may be connected to the first weight support. In some embodiments, the connector may be biased toward the bar by a biasing element. The biasing element may be any biasing element, such as a spring (e.g., a coil spring, a Belleville washer, a wave spring, a leaf spring), a gas piston, an elastically compressible material, a magnetic biasing element, any other biasing element, and combinations thereof.

While embodiments of the present disclosure show or describe the connector as moving transverse to the rod, it should be understood that the connector may move in any direction to connect or disconnect the weight supports. For example, the connector may rotate to engage or disengage the connector. In some embodiments, the axis may be parallel to the longitudinal axis, but offset from the longitudinal axis. In some embodiments, the axis may be transverse to the longitudinal axis. In some embodiments, the connector may move in a direction parallel to the longitudinal axis.

To move the connector between the connected position or configuration and the disconnected position or configuration, the rod may be rotated relative to the selector. Because the rod and the selector are connected with a rotatable connection, rotating the rod may cause the selector to move along the longitudinal axis. In some embodiments, the orientation of the selector may be maintained while the rod is rotating. For example, the selector may be prevented from rotating with the rod by the inner surface of the weight supports. In some embodiments, the selector may be housed in a selector housing that is configured to prevent movement of the selector. The selector housing may extend through the center cavity of the weight supports.

As discussed herein, as the selector moves along the longitudinal axis, the selector may contact the connector and push the connector away from the bar. In this manner, the selector may move the connector from the connected position to the disconnected position.

In some embodiments, the second weight support includes two connectors located on opposite sides of the bar. However, it should be understood that the weight supports may include any number of connectors, including 1, 2, 3, 4, 5, 6, 7, 8, 9, 10, or more connectors. The number of connectors may be selected based on stability, strength, and other factors.

In some embodiments, the rod may be rotated using a rotation mechanism. In the embodiment shown, the rotation mechanism is a dial or a drive gear. The dial extends out of the housing of the base. In some embodiments, the dial may be rotated by a user's hand. The dial may include one or more markings associated with a connected weight of the adjustable kettlebell. The markings may be associated with a rotational position of the rod, which may, in turn, be associated with a position of the selector along the rod. In this manner, the user may adjust the weight of the adjustable kettlebell by rotating the dial until the marking associated with the desired weight is selected.

In some embodiments, the rotation mechanism may be powered by an electric motor. The electric motor may be connected to the drive gear, such as by a geared connection and/or a belt or chain. The electric motor may rotate the drive gear, thereby causing the rod to rotate, and the rotation of the rod may cause the selector to move along the longitudinal axis. As discussed herein, in some embodiments, the position of the selector may be determined using one or more position sensors on the selector, a rotational position of the rod, position sensors on the connector, any other way, and combinations thereof.

In accordance with embodiments of the present disclosure, the selection mechanism for the adjustable kettlebell may be primarily located in and/or connected to the base. The only moving parts of the selection mechanism may be the connector and the biasing element. This may help to simplify the construction of the adjustable kettlebell. Conventional adjustable kettlebells have a complex selection mechanism located in the handle of the kettlebell. However, kettlebells are often used dynamically, and are subject to dropping, jarring, hitting walls, floors, ceilings, and other surfaces. This contact may cause damage to a selection mechanism, especially over time and repeated contact. By limiting the moving parts within the handle and/or weight plates, the reliability and/or operational lifetime of the adjustable kettlebell may be greatly increased.

Furthermore, by including the selection mechanism in the base, the manufacturing of the weight supports and/or the handle may be simplified, thereby reducing costs. This may further allow for the modification and/or substitution of various parts of the adjustable kettlebell. This may save the user money by increasing the modularity of the adjustable kettlebell.

In some embodiments, the adjustable kettlebell includes a handle. The handle is connected to a plurality of weight supports. Each weight support is connected to its underlying weight support with a connector. For example, a second weight support is connected to a first weight support with a second connector. A third weight support is connected to the second weight support with a third connector. A fourth weight support is connected to the third weight support with a fourth connector. The handle is connected to the fourth weight support with a handle connector. The first weight support is the lowest weight support and the first connector is not connected to any other weight support.

The connected weight of the adjustable kettlebell is the combined weight of the handle and any connected weight supports and associated weight plates. For example, if the handle weighs 10 lb., and each weight support and associated weight plates weight 10 lb., then the combined weight of the adjustable kettlebell connected to four weight plates is 50 lb. As discussed herein, it should be understood that the weight of the weight supports and/or associated weight plates may be adjusted to add more or less weight to the adjustable kettlebell when connected to the weight supports.

During use, the adjustable kettlebell may be removed or separated from the base. After an exercise activity (such as a weight lifting set of a series of repeated motions), the user may place the adjustable kettlebell in the base (e.g., in the cradle). For example, the user may place the adjustable kettlebell on the base so that the first weight support is resting on the base.

In some embodiments, as the adjustable kettlebell is placed on the base, the selector may contact or engage the first connector. This may push the first connector away from the rod. In some embodiments, the first weight support may not include a first connector. In some embodiments, the first connector may engage with or connect to a bar that is connected to the base. In this manner, the first connector may stay connected to the base when the handle is removed from the base during an exercise activity.

In accordance with embodiments of the present disclosure, to adjust the connected weight of the adjustable dumbbell, the user may input a desired weight into the adjustable kettlebell assembly (e.g., system). For example, the user may adjust a dial on the base, input the desired weight into an input on the base, input the desired weight into a remote computing device, or otherwise input a desired weight. To adjust the connected weight of the adjustable kettlebell, the adjustable kettlebell system may move the selector along the length of the rod. For example, the adjustable kettlebell system may rotate the rod, which may be connected to the selector with a threaded connection. Rotation of the rod may cause the selector to move along the length of the rod.

In some embodiments, the rod may be rotated such that the selector moves from the first engagement position to the second engagement position. As discussed herein, the connectors may be biased toward the rod. As the selector moves from the first engagement position to the second engagement position, the first connector may move toward the rod. In some embodiments, the first connector may engage with a base bar. The base bar may be connected to the base, thereby securing the first weight support to the base.

As the selector moves up the length of the rod into the second engagement position, the selector may engage the second connector. The selector may push or urge the second connector away from the rod. This may cause the second connector to disengage from the first bar. Put another way, the hook of the second connector may be moved away from the second bar such that, when the second weight support is moved upward, the second connector may not engage with the second bar, and the second weight support may be separated from the first weight support.

The user may then remove the adjustable kettlebell from the base. When the adjustable kettlebell has been removed from the base, the handle is connected to the fourth weight support, which is connected to the third weight support, which is connected to the second weight support. The first weight support may remain connected to or secured to the base. In this manner, the connected weight of the adjustable kettlebell may be changed. For example, if the handle and each of the weight supports and associated weight plates weigh 10 lb., the connected weight of the adjustable kettlebell may be 40 lb.

As discussed herein, because the first connector is connected to the base bar, the first weight support may be connected to the base. This may help prevent the first weight support from being misplaced, dropped, damaged, or otherwise inadvertently removed from the base.

Each of the weight supports may be selectively engaged or disengaged from the underlying weight support. In this manner, the connected weight of the adjustable kettlebell may be selectively adjusted or changed. This may reduce the amount of equipment that a user, gym, or other individual or group may purchase or utilize. This may further reduce the surface footprint of the user's exercise equipment.

To further adjust the connected weight of the adjustable kettlebell, the selector may be moved to the third engagement position shown. In the third engagement position, the selector has pushed the third connector away from the second bar. When the handle was removed from the base, the third weight support was disengaged from the second weight support. The handle may remain connected to the fourth weight support, which may remain connected to the third weight support. Thus, the connected weight of the adjustable kettlebell may be 30 lb.

When the selector is moved into the fourth engagement position, the fourth connector may be disengaged from the third bar, thereby allowing the fourth weight support to be disconnected from the third weight support. The handle may be connected to the fourth weight support. Thus, in the view shown, the connected weight of the adjustable kettlebell may be 20 lb.

When the selector is moved into the fifth engagement position, the handle connector may be disengaged from the fourth bar. This may allow the handle to be disconnected from the fourth weight support. In this manner, when the handle is removed from the base, the handle may not be connected to any of the weight supports. Thus, the connected weight of the adjustable kettlebell may be 10 lb.

The adjustable kettlebell system may selectively adjust the connected weight of the adjustable kettlebell. This may allow the user to perform exercise activities with a desired amount of connected weight. This may further increase the versatility of the user's exercise equipment.

In some embodiments, the rod may be rotated at the base. This may reduce the complexity of the adjustment mechanism of the adjustable kettlebell. For example, as discussed herein, the adjustable kettlebell may be subject to drops, bumps, jostles, and so forth. This may improve the reliability of the adjustable kettlebell system.

In some embodiments, a motor, such as an electric motor, may be located in the base. The motor may be connected to the rod in the base. The motor may rotate the rod. As discussed herein, as the motor rotates the rod, the rotation of the rod may cause the selector to move along the length of the rod. In some embodiments, the motor may be directly connected to the selector. For example, the motor may be a linear motor or a piston, and the motor may directly move the selector along the length of the shaft.

In some embodiments, the rod may be rotatable by a drive gear. The drive gear may be fixedly or rigidly connected to the rod. In some embodiments, the drive gear may be rotatable by hand. For example, the drive gear may extend out of the housing of the base, and the user may manually rotate the drive gear to rotate the rod. In some embodiments, the drive gear may be rotated using the motor. For example, the motor may be connected to the drive gear with a belt, cable, chain, or other connector. The motor may rotate the belt, which may then rotate the drive gear. In some embodiments, the motor may be connected to the drive gear with a geared connection.

In some embodiments, the adjustable kettlebell system may include one or more sensors that may determine the connected weight of the adjustable kettlebell. For example, the rod may include a rotational position sensor to sense the rotational position of the rod. The rotational position of the rod may be associated with the position of the selector. By understanding the rotational position of the rod, the position of the selector along the length of the rod may be inferred. In this manner, the adjustable kettlebell system may determine in which engagement position the selector is located (e.g., the first engagement position, the second engagement position, the third engagement position, the fourth engagement position, or the fifth engagement position). In some embodiments, the motor may include a rotational position sensor to sense the rotational position of the motor, and therefore the rotational position of the rod.

In some embodiments, the rod and the selector may include sensors to determine the position of the selector on the rod. For example, the rod may include a rod sensor and the selector may include a selector sensor. When the rod sensor senses the selector sensor, the adjustable kettlebell may determine the position of the selector. The connected weight of the adjustable kettlebell may then be determined based on the position of the selector on the rod. In some embodiments, each of the connectors may include a connector position sensor. The connector position sensor may determine whether the connector is located in the connected position or the disconnected position. The connected weight of the adjustable kettlebell may be determined based on which connector is located in the disconnected position.

In some embodiments, an adjustable kettlebell system includes an exercise program manager. The exercise program manager may implement an exercise program. The exercise program may include one or more exercise activities which may utilize an adjustable kettlebell. The exercise activities may be performed using different connected weights of the adjustable kettlebell.

When an exercise activity utilizes a different connected weight, the exercise program manager may instruct a selection mechanism to adjust the connected weight of the adjustable kettlebell. In some embodiments, the selection mechanism may cause a motor to rotate a rod. Rotation of the rod may cause a selector to move along the length of the rod. The selector may engage with one or more connectors of the weight plates. This may cause the weight support to be disengaged from the underlying weight support. In this manner, the selection mechanism may change the connected weight of the adjustable kettlebell based on the particular exercise activity identified by the exercise program manager.

In some embodiments, the kettlebell system may include a communication port. The communication port may receive communications from a remote computing device. In some embodiments, the remote computing device may transmit one or more exercise programs to the kettlebell system. For example, the communication port may receive one or more exercise programs from an exercise server. The communication port may communicate the received exercise programs to be implemented by the exercise program manager.

In some embodiments, the communication port may receive information from a commercially managed exercise server. A user may receive one or more commercially prepared exercise programs that are transmitted from the exercise server. In some embodiments, the communication port may receive information from a mobile device, such as a smart phone or tablet. A user may develop his or her own exercise program on the mobile device and transmit it to the communication port. In some embodiments, the user may instruct the selection mechanism to change the connected weight of the adjustable kettlebell through the mobile device.

In some embodiments, the kettlebell system may include an input device. The input device may allow a user to adjust the connected weight of the adjustable kettlebell and/or implement an exercise program. In some embodiments, the input device may include a dial, and the user may rotate the dial to select a desired weight. In some embodiments, the input device may include one or more buttons, such as a keyboard, a keypad, a number pad, a touchscreen, and so forth. The user may press a button or series of buttons associated with a particular connected weight of the adjustable kettlebell. In some embodiments, the input device may include a microphone and voice recognition software. The user may speak one or more commands, which the voice recognition software may recognize as an instruction to perform an activity. For example, the user may provide an instruction to change the connected weight of the adjustable kettlebell, implement an exercise program, and so forth.

In some embodiments, the kettlebell system may include one or more sensors. The selection mechanism may utilize the one or more sensors may be used to determine the connected weight of the adjustable kettlebell. For example, a rotational sensor may sense a rotational position of the rod, and the rotational position may be used to infer the position of the selector. In some embodiments, a rod sensor on the rod, with an associated selector sensor on the selector, may determine the position of the selector on the rod sensor. The position of the selector on the rod may then be used to infer the connected weight of the adjustable kettlebell. In some embodiments, the connectors on the weight supports may include one or more connector sensors. The connector sensors may determine whether a connector of a particular weight support is in the connected position or the disconnected position. The connected weight of the adjustable kettlebell may be inferred based on which connector is in the disconnected position.

In some embodiments, a method for adjusting a weight of an adjustable kettlebell includes rotating a rod. The rod is connected to the base or cradle of an adjustable kettlebell system. The rod may extend through an adjustable kettlebell. For example, the rod may extend through the center cavity of a plurality of weight plates. Each weight plate may be connected to a weight support, and the rod may extend through the weight support. In some embodiments, based on rotating the rod, a selector may be slid along the rod. As the selector slides along the rod, the selector may engage a connector in the weight supports. The connector may be moved from a connected position to a disconnected position. Moving the connector from the connected position to the disconnected position may cause the weight support or the weight plate to be disconnected or disengaged from the underlying weight plate or weight support. Moving the selector to engage with a particular connector of a particular weight support may allow the user to adjust the connected weight of the adjustable kettlebell.

In some embodiments, the method may include receiving an input to change the connected weight of the adjustable kettlebell. In some embodiments, the input may be received from an exercise program. In some embodiments, the input may be received from a user input. The user input may be received from a remote device. In some embodiments, the user input may be received from an input device on the adjustable kettlebell or the base.

Following are sections in accordance with embodiments of the present disclosure:

A1. A kettlebell system, comprising:
- a base;
- a rod extending up from the base;
- a selector slidingly attached to the rod;
- a first weight support, the rod extending through the first weight support; and
- a second weight support stacked on the first weight support, the rod extending through the second weight support, wherein the second weight support includes a connector, wherein, in a connected position, the connector is connected to the first weight support and in a disconnected position, the connector is not connected to the first weight support.

A2. The kettlebell system of Section A1, wherein, in the disconnected position, the selector moves the connector away from the rod.

A3. The kettlebell system of any of Sections A1 or A2, wherein the connector is biased toward the rod.

A4. The kettlebell system of any of Sections A1-A3, wherein the selector is connected to the rod with a threaded connection such that a rotation of the rod moves the selector along a length of the rod.

A5 The kettlebell system of any of Sections A1-A4, wherein the rod is connected to a drive gear located in the base.

A6. The kettlebell system of Section A5, wherein the drive gear is rotatable by an electric motor.

A7. The kettlebell system of any of Sections A1-A6, further comprising a third weight support stacked on the second weight support, and wherein the third weight support is selectively connected to the second weight support.

A8. The kettlebell system of any of Sections A1-A7, wherein the first weight support includes:

a first section;

a second section; and a bar extending between the first section and the second section, wherein, in the connected position, the connector is engaged with the bar.

A9. The kettlebell system of any of Sections A1-A8, further comprising:

a first weight plate connected to the first weight support; and a second weight plate connected to the second weight support.

B1. A selection mechanism for an adjustable kettlebell system, comprising:

a rod extending from a base;

a selector movable along a length of the rod; and a connector movable between a connected position and a disconnected position, the connector being movable through a contact with the selector, wherein, in the connected position, the connector connects a first weight support to a second weight support, and wherein, in the disconnected position, the first weight support is not connected to the second weight support.

B2. The selection mechanism of Section B1, wherein the connector is movable in a direction transverse to the length of the rod.

B3. The selection mechanism of any of Sections B1 or B2, wherein the connector is biased to the connected position with a biasing element.

B4. The selection mechanism of Section B3, wherein the biasing element includes a spring.

B5. The selection mechanism of any of Sections B1-B4, further comprising:

a drive gear fixedly connected to the rod; and a motor configured to rotate the drive gear.

C1 A method for adjusting a weight of an adjustable kettlebell, comprising:

rotating a rod connected to a base of the adjustable kettlebell, the rod extending through the adjustable kettlebell, the adjustable kettlebell including a plurality of weight plates;

based on rotating the rod, sliding a selector along a length of the rod; and moving a connector from a connected position to a disconnected position based on a position of the selector along the length of the rod.

C2. The method of Section C1, wherein moving the connector includes contacting the connector with the selector.

C3. The method of any of Sections C1 or C2, further comprising receiving an input for a connected weight, and wherein rotating the rod includes rotating the rod until the selector moves the connector to the disconnected position for a weight support associated with the connected weight.

C4. The method of any of Sections C1-C3, wherein rotating the rod includes rotating the rod with a motor.

C5. The method of any of Sections C1-C4, further comprising, before rotating the rod, placing the adjustable kettlebell in the base.

C6. The method of any of Sections C1-C5, wherein the connector is connected to a weight support, and wherein the connector is selectively connected to a bar on an underlying weight support, and further comprising removing the adjustable kettlebell from the base, wherein the underlying weight support is connected to the base when the adjustable kettlebell is removed.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A kettlebell system, comprising:

a base;

a rod extending up from the base;

a selector slidingly attached to the rod;

a first weight support, the rod extending through the first weight support; and a second weight support stacked on the first weight support, the rod extending through the second weight support, wherein the second weight support includes a connector, wherein, in a connected position, the connector is connected to the first weight support and in a disconnected position, the connector is not connected to the first weight support.

2. The kettlebell system of claim 1, wherein, in the disconnected position, the selector moves the connector away from the rod.

3. The kettlebell system of claim 1, wherein the connector is biased toward the rod.

4. The kettlebell system of claim 1, wherein the selector is connected to the rod with a threaded connection such that a rotation of the rod moves the selector along a length of the rod.

5. The kettlebell system of claim 1, wherein the rod is connected to a drive gear located in the base.

6. The kettlebell system of claim 5, wherein the drive gear is rotatable by an electric motor.

7. The kettlebell system of claim 1, further comprising a third weight support stacked on the second weight support, and wherein the third weight support is selectively connected to the second weight support.

8. The kettlebell system of claim 1, wherein the first weight support includes:

a first section;

a second section; and a bar extending between the first section and the second section, wherein, in the connected position, the connector is engaged with the bar.

9. The kettlebell system of claim 1, further comprising:

a first weight plate connected to the first weight support; and a second weight plate connected to the second weight support.

10. A selection mechanism for an adjustable kettlebell system, comprising:

a rod extending from a base;

a selector movable along a length of the rod; and a connector movable between a connected position and a disconnected position, the connector being movable through a contact with the selector, wherein, in the connected position, the connector connects a first weight support to a second weight support, and wherein, in the disconnected position, the first weight support is not connected to the second weight support.

11. The selection mechanism of claim 10, wherein the connector is movable in a direction transverse to the length of the rod.

12. The selection mechanism of claim 10, wherein the connector is biased to the connected position with a biasing element.

13. The selection mechanism of claim 12, wherein the biasing element includes a spring.

14. The selection mechanism of claim 10, further comprising:

a drive gear fixedly connected to the rod; and a motor configured to rotate the drive gear.

15. A method for adjusting a weight of an adjustable kettlebell, comprising:

rotating a rod connected to a base of the adjustable kettlebell, the rod extending through the adjustable kettlebell, the adjustable kettlebell including a plurality of weight plates;

based on rotating the rod, sliding a selector along a length of the rod; and moving a connector from a connected position to a disconnected position based on a position of the selector along the length of the rod.

16. The method of claim 15, wherein moving the connector includes contacting the connector with the selector.

17. The method of claim 15, further comprising receiving an input for a connected weight, and wherein rotating the rod includes rotating the rod until the selector moves the connector to the disconnected position for a weight support associated with the connected weight.

18. The method of claim 15, wherein rotating the rod includes rotating the rod with a motor.

19. The method of claim 15, further comprising, before rotating the rod, placing the adjustable kettlebell in the base.

20. The method of claim 15, wherein the connector is connected to a weight support, and wherein the connector is selectively connected to a bar on an underlying weight support, and further comprising removing the adjustable kettlebell from the base, wherein the underlying weight support is connected to the base when the adjustable kettlebell is removed.

* * * * *